US006801193B2

(12) United States Patent
Nakamura et al.

(10) Patent No.: US 6,801,193 B2
(45) Date of Patent: Oct. 5, 2004

(54) DIGITAL DRIVE APPARATUS AND IMAGE DISPLAY APPARATUS USING THE SAME

(75) Inventors: Junichi Nakamura, Shiojiri (JP); Hideya Seki, Okaya (JP); Masatoshi Yonekubo, Hara-mura (JP)

(73) Assignee: Seiko Epson Corporation, Tokyo (JP)

( * ) Notice: Subject to any disclaimer, the term of this patent is extended or adjusted under 35 U.S.C. 154(b) by 219 days.

(21) Appl. No.: 09/808,143

(22) Filed: Mar. 15, 2001

(65) Prior Publication Data

US 2002/0024508 A1 Feb. 28, 2002

(30) Foreign Application Priority Data

Mar. 27, 2000 (JP) ..... 2000-087145
Feb. 23, 2001 (JP) ..... 2001-048478

(51) Int. Cl.[7] ..... G09G 5/00

(52) U.S. Cl. ..... 345/204; 345/4; 345/5; 345/6

(58) Field of Search ..... 345/204, 690, 345/4, 5, 6; 257/296; 341/144; 365/233

(56) References Cited

U.S. PATENT DOCUMENTS 4,283,784 A * 8/1981 Horan ..... 368/87
4,805,093 A * 2/1989 Ward ..... 711/108
5,670,976 A * 9/1997 Chiu et al. ..... 345/84
5,777,588 A * 7/1998 Woodgate et al. ..... 345/6
6,184,852 B1 * 2/2001 Millward et al. ..... 345/84
6,198,469 B1 * 3/2001 Tjandrasuwita ..... 345/690
6,271,783 B1 * 8/2001 Cairns et al. ..... 341/144
6,344,672 B2 * 2/2002 Huffman ..... 257/296
6,347,063 B1 * 2/2002 Dosaka et al. ..... 365/233
6,388,661 B1 * 5/2002 Richards ..... 345/204
6,452,589 B1 * 9/2002 McKnight ..... 345/205
6,473,122 B1 * 10/2002 Kanekal ..... 348/340

* cited by examiner

*Primary Examiner*—Vijay Shankar
*Assistant Examiner*—Prabodh M. Dharia
(74) *Attorney, Agent, or Firm*—Oliff & Berridge, PLC

(57) ABSTRACT

A digital drive apparatus has a memory cell array. Each memory cell includes a storage section that stores a supply of data therein and that is capable of keeping output corresponding to the stored data, and a transfer element that is capable of transferring the data to the storage section. The memory cell also has an address terminal that supplies an address signal to the transfer element, a data terminal that is connected with the transfer element and supplies the data to the storage section via the transfer element, and an output terminal that outputs the data stored in the storage section. The memory cell further includes a reset terminal that supplies a reset signal, which sets the output of the storage section to a predetermined state, to the storage section regardless of the data previously stored in the storage section.

26 Claims, 16 Drawing Sheets

ON STATE

OFF STATE

DIGITAL DRIVE APPARATUS AND IMAGE DISPLAY APPARATUS USING THE SAME

BACKGROUND OF THE INVENTION

1. Field of the Invention

The present invention relates to an image display apparatus, and more specifically to a digital drive apparatus to drive a light emission apparatus.

2. Description of the Related Art

Image display apparatuses have various types in terms of multi-color image reproduction. The first type is a three panel type applied for projectors. This method uses, for example, three liquid crystal panels corresponding to three color light components of red, green, and blue, and combines three color images produced by the three liquid crystal panels, so as to reproduce a multi-color image. The second type is a color filter type applied for direct viewing image display apparatuses. This method uses, for example, one liquid crystal panel, where three light modulation elements (liquid crystal cells) emitting different colors form one pixel, and reproduces a multi-color image by means of spatial color mixing. The third type is a color sequential type. This method, for example, successively irradiates one liquid crystal panel with three color light components and sequentially displays corresponding color images produced by the liquid crystal panel. Namely this method reproduces a multi-color image by means of the time-based color mixing function of human eyes.

The image display apparatus generally includes a light modulation device, such as a liquid crystal panel, and a digital drive device that drives the light modulation device. The digital drive device has a memory cell array including a plurality of memory cells that respectively actuate a plurality of light modulation elements included in the light modulation device.

In the course of using the image display apparatus, for example, at the time of rewriting an image, each light modulation element should forcibly be set to a predetermined state such as OFF state (state that prohibits emission of light). Especially in the image display apparatus that adopts the color sequential technique, the digital drive device is required to actuate the light modulation device in response to color image data corresponding to each of color light components successively output to the light modulation device. The digital drive device should thus set each light modulation element in OFF state before the light modulation device is irradiated with each color light component.

The prior art digital drive device, however, has difficulties in setting the light modulation element in OFF state. The prior art system uses two sub-frame periods for display of a color image of one picture screen. This takes a relatively long time. In the prior art technique, each light modulation element is selectively set in ON state (state that allows emission of light) in a fist sub-frame period, and is necessarily set in OFF state in a second sub-frame period. Color image data are written into each memory cell of the digital drive device in the first sub-frame period. Specific data to set each light modulation element in OFF state are then written into the memory cell in the second sub-frame period.

The problem discussed above is not restricted to the image display apparatus that adopts the color sequential technique but is also found in image display apparatuses that adopt different techniques.

SUMMARY OF THE INVENTION

The object of the present invention is to solve the above problem of the prior art systems and thus to provide a technique that enables each light emission element, such as a light modulation element, included in an image display apparatus to be readily set in a predetermined state.

At least part of the above and the other related objects is attained by a first apparatus of the present invention that is a digital drive apparatus, which has a memory cell array including a plurality of memory cells that are arranged in a matrix. Each of the memory cells includes: a storage section that stores a supply of data therein and that is capable of keeping output corresponding to the stored data; a transfer element that is capable of transferring the data to the storage section; an address terminal that supplies an address signal to the transfer element, the address signal controlling operation of the transfer element; a data terminal that is connected with the transfer element and supplies the data to the storage section via the transfer element; an output terminal that outputs the data stored in the storage section; and a reset terminal that supplies a reset signal to the storage section, the reset signal setting the output of the storage section to a predetermined state regardless of the data previously stored in the storage section.

In this digital drive apparatus, each memory cell has a reset terminal. This arrangement enables the output of the storage section to be readily set to a predetermined state, irrespective of the data previously stored in the storage section. Application of this digital drive apparatus to an image display apparatus having a light emission apparatus enables each light emission element to be readily set in a predetermined state.

In accordance with one preferable embodiment of the above digital drive apparatus, the storage section includes an inverter and either a 2-input NAND gate or a 2-input NOR gate. An output terminal of the 2-input NAND gate or the 2-input NOR gate is connected with an input terminal of the inverter. One input terminal of the 2-input NAND gate or the 2-input NOR gate is connected with an output terminal of the inverter, whereas the other input terminal is connected with the reset terminal.

This arrangement simplifies the construction of the storage section.

In the digital drive apparatus, it is preferable that the memory cell further includes a buffer circuit that converts an output voltage of the storage section.

This arrangement enables each memory cell to have an output of an arbitrary voltage level, while desirably reducing the power consumption of the storage section. Application of this digital drive apparatus to an image display apparatus having a light emission apparatus allows actuation of each light emission element that works at an arbitrary voltage level.

In accordance with another preferable embodiment of the above digital drive apparatus, the memory cell array further includes: a plurality of first signal lines, each of the first signal lines connecting in parallel one set of address terminals, which are included in one set of memory cells aligned in a direction of rows; a plurality of second signal lines, each of the second signal lines connecting in parallel one set of data terminals, which are included in one set of memory cells aligned in a direction of columns; and a plurality of third signal lines, each of the third signal lines connecting in parallel one set of reset terminals, which are included in the one set of memory cells aligned in the direction of rows. In this embodiment, the digital drive apparatus further has: a first driver circuit that sequentially supplies the address signal to each set of memory cells aligned in the direction of rows via the plurality of first signal lines; a second driver circuit that simultaneously supplies the data signal to respective sets of memory cells arranged in the direction of columns via the plurality of second signal lines; and a third driver circuit that sequentially supplies the reset signal to each set of memory cells aligned in the direction of rows via the plurality of third signal lines.

This arrangement sequentially sets the outputs of the respective sets of memory cells arranged in the direction of rows to a predetermined state.

In the digital drive apparatus of the above embodiment, it is preferable that the third driver circuit is capable of supplying the reset signal to a specific set of memory cells at a specific timing after the first driver circuit has supplied the address signal to the specific set of memory cells.

This arrangement causes the output of the storage section to be set to a predetermined state at a specific timing after the data are written into the storage section. Application of this digital drive apparatus to an image display apparatus having a light emission apparatus enables each light emission element to be set in a predetermined state at a specific timing.

In the digital drive apparatus of this preferable arrangement, the specific timing is variable.

This arrangement causes the output of the storage section to be set to a predetermined state at a desired timing after the data are written into the storage section. Application of this digital drive apparatus to an image display apparatus having a light emission apparatus enables each light emission element to be set in a predetermined state at a desired timing. This results in adjusting the light emission time in the light emission apparatus.

In accordance with one preferable application, the digital drive apparatus further has a control circuit that causes the first driver circuit and the third driver circuit to output the address signal and the reset signal in one frame period.

This arrangement supplies the address signal and the reset signal to each memory cell in an identical frame period, thus allowing data to be rewritten in one frame period. Application of this digital drive apparatus to an image display apparatus having a light emission apparatus ensures display of different images in respective frame periods.

The present invention is also directed, as its second apparatus, to an image display apparatus that includes: a digital drive apparatus having any of the above arrangements; and a light emission apparatus that includes a plurality of light emission elements, which emit light in response to output of the plurality of memory cells included in the digital drive apparatus.

The image display apparatus includes the digital drive apparatus discussed above as the first apparatus of the present invention, and thus enables each light emission element to be readily set to a predetermined state.

In accordance with one preferable application, the image display apparatus further has a lens that projects the light emitted from the light emission apparatus.

This arrangement constructs a projector.

In the above image display apparatus, each of the plurality of light emission elements may modulate externally given incident light and emit modulated light.

The present invention also provides, as its third apparatus, a digital storage unit that includes: a storage section that stores therein data representing state of a light modulation element; an active element that is capable of transferring the data to the storage section; a data terminal that supplies the data to the storage section via the active element; an address terminal that supplies an address signal to the active element, the address signal controlling the active element; and a reset terminal that supplies a reset signal to the storage section, the reset signal resetting the storage section.

The digital storage unit has a reset terminal, which enables the storage section to be reset, irrespective of the data previously stored in the storage section. This results in readily setting the light modulation element to a predetermined state.

In the above digital storage unit, the storage section may be an SRAM circuit having a reset function.

In accordance with one preferable embodiment of this digital storage unit, the SRAM circuit has either a 2-input NAND gate or a 2-input NOR gate, where the reset signal is given to one of input terminals, and an inverter. The 2-input NAND gate or the 2-input NOR gate and the inverter are connected to each other to form a loop.

This relatively simplifies the construction of the storage section.

In accordance with one preferable application, the digital storage unit further has a buffer circuit that converts an output voltage of the storage section and transmits the converted output voltage to the light modulation element.

Each digital storage unit can thus actuate the light modulation element that works at an arbitrary voltage level.

A fourth apparatus of the present invention is a digital storage apparatus that includes: a plurality of digital storage units that have any of the above arrangements and are arranged in a two-dimensional manner; a plurality of first signal lines, each of the first signal lines connecting in parallel one set of address terminals, which are included in one set of digital storage units aligned in a first direction, each first signal line receiving the address signal; a plurality of second signal lines, each of the second signal lines connecting in parallel one set of data terminals, which are included in one set of digital storage units aligned in a second direction that is perpendicular to the first direction, each second signal line receiving the data signal; and a plurality of third signal lines, each of the third signals lines connecting in parallel one set of reset terminals, which are included in the one set of digital storage units aligned in the first direction, each third signal line receiving the reset signal.

In this digital storage apparatus, a plurality of digital storage units are arranged in a two-dimensional manner to store two-dimensional data, such as image data.

The present invention is further directed, as its fifth apparatus, a digital drive apparatus that includes: a digital storage apparatus of the above arrangement; a first driver circuit that causes the address signal to be supplied to the plurality of first signal lines; a second driver circuit that causes the data signal to be supplied to the plurality of second signal lines; and a third driver circuit that causes the reset signal to be supplied to the plurality of third signal lines.

In accordance with one preferable embodiment of the digital drive apparatus, the third driver circuit is capable of supplying the reset signal to a specific set of digital storage units at a specific timing after the first driver circuit has supplied the address signal to the specific set of digital storage units.

This arrangement allows the storage section to be reset at a specific timing after the data are written into the storage section. This results in setting each light modulation element to a predetermined state at a specific timing.

In the above digital drive apparatus, the first driver circuit may include a shift register circuit and an AND logic circuit.

This ensures output of the address signal having a relatively high time-based resolution.

In the above digital drive apparatus, the third driver circuit may include a shift register circuit and an AND logic circuit.

This ensures output of the reset signal having a relatively high time-based resolution.

In accordance with another preferable embodiment of the digital drive apparatus, the second driver circuit includes a shift register circuit and an analog switch circuit, and an enable signal that regulates output timing of the data signal is supplied to the analog switch circuit.

This arrangement specifies the output timing of the data signal to the plurality of second signal lines with a high accuracy.

In accordance with still another preferable embodiment of the digital drive apparatus, the second driver circuit includes a plurality of partial driver circuits, and each of the partial driver circuits supplies the data signal to at least part of the plurality of digital storage units.

This ensures relatively quick supply of the data signal to each digital storage unit.

In accordance with one preferable application, the digital drive apparatus further has a control circuit that causes the first driver circuit and the third driver circuit to output the address signal and the reset signal in an identical frame period.

This arrangement supplies the address signal and the reset signal to each digital storage unit in an identical frame period, thus allowing data to be rewritten in one frame period. Each light modulation element ensures display of different images in respective frame periods.

A sixth apparatus of the present invention is an image display apparatus that includes: a digital drive apparatus having any of the above arrangements; and the light modulation elements, each being driven by each of the plurality of digital storage units included in the digital drive apparatus.

The image display apparatus includes the digital drive apparatus discussed above as the fifth apparatus of the present invention, and thus enables each light modulation element to be readily set to a predetermined state.

In accordance with one preferable application, the image display apparatus further has a lens that projects the light output from the light modulation elements.

This arrangement constructs a projector.

The present invention is further directed to a method of controlling the digital drive apparatus discussed above. The method has the step of causing the third driver circuit to supply the reset signal to a specific set of digital storage units at a specific timing after the first driver circuit has supplied the address signal to the specific set of digital storage units.

This arrangement allows the storage section to be reset at a specific timing after the data are written into the storage section. This results in setting each light modulation element to a predetermined state at a specific timing.

In the above method it is preferable that the address signal and the reset signal are supplied in an identical frame period.

This arrangement supplies the address signal and the reset signal to each digital storage unit in an identical frame period, thus allowing data to be rewritten in one frame period. Each light modulation element ensures display of different images in respective frame periods.

DESCRIPTION OF THE PREFERRED EMBODIMENTS

Figure 1:
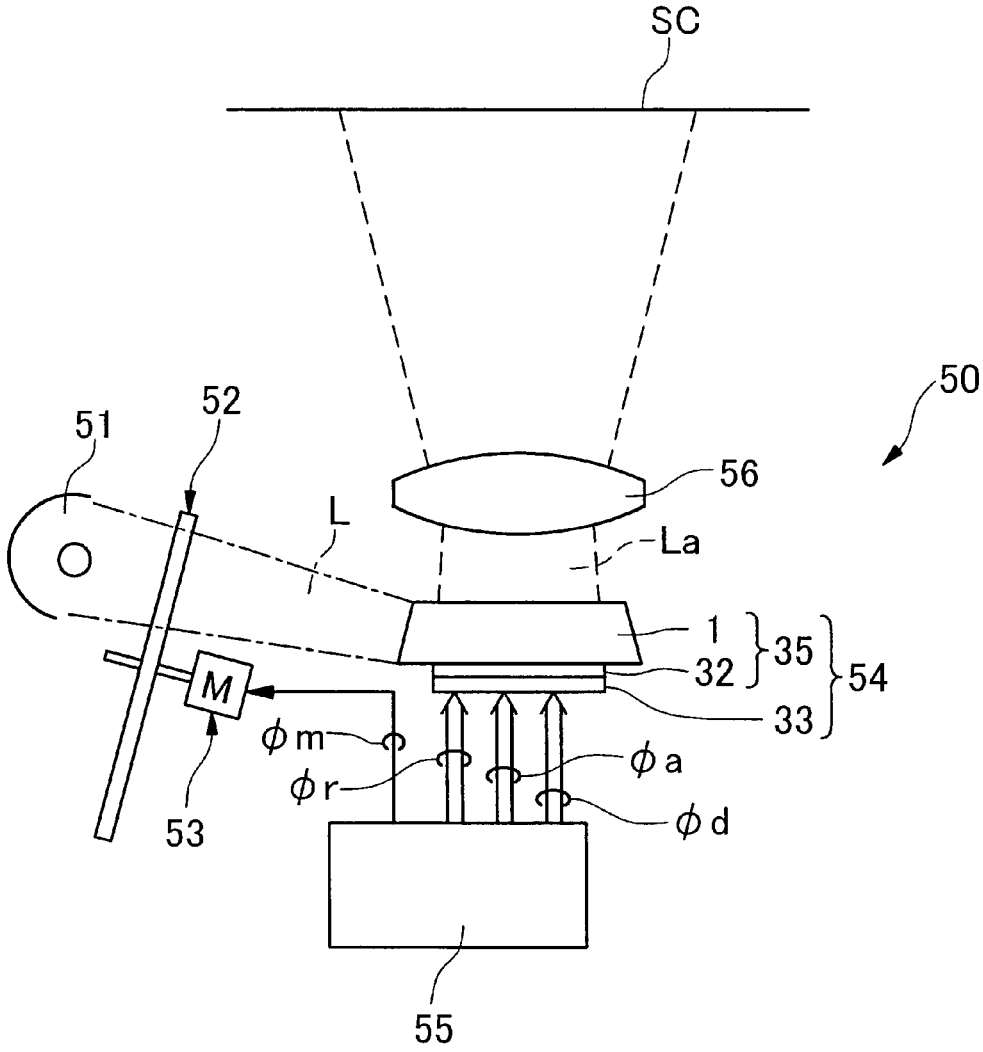
FIG. 1 illustrates an image display apparatus 50 in a first embodiment of the present invention.

Some modes of carrying out the present invention are discussed below in accordance with embodiments thereof in the following order:

A. First Embodiment:

A-1. Image Display Apparatus:

A-2. Image Formation Section:

A-3. Digital Drive Device:

A-4. Modifications:

B. Second Embodiment:

B-1. Modifications:

A. First Embodiment:

A-1. Image Display Apparatus:

FIG. 1 illustrates an image display apparatus 50 in a first embodiment of the present invention. The image display apparatus 50 is a projector and includes a light source device 51, a rotary color filter 52, a motor 53, an image formation section (image display unit) 54, a control circuit (image control circuit) 55, and a projection lens 56.

The light source device 51 emits white light. The rotary color filter 52 has a quasi-circular shape and is divided into three areas. The three areas respectively include filters that allow selective transmission of three color light components, red, green, and blue. The rotary color filter 52 is driven to rotate by the motor 53 and successively extracts and emits the three color light components, red, green, and blue, of the white light emitted from the light source device 51.

The image formation section 54 includes a light modulation device 35, which has a light guiding plate 1 and a switching section 32, and a digital drive device 33. Respective color light components L output from the rotary color filter 52 successively enter the light guiding plate 1. The switching section 32 is driven by the digital drive device 33 to successively modulate (switch on and off) the respective color light components L entering the light guiding plate 1. The image formation section 54 enables each color light L to be emitted upward in the drawing with regard to each pixel. Each color light emitted with regard to the respective pixels forms a color image light La representing an image of the corresponding color.

The control circuit 55 controls the operations of the rotary color filter 52 and the image formation section 54. The control circuit 55 sends motor control signals $\phi m$ to the motor 53, while transmitting color image data signals $\phi d$, address signals (scanning signals) $\phi a$, and reset signals $\phi r$ to the image formation section 54. The color image data signals $\phi d$ represent color images corresponding to the respective color light components. The address signals $\phi a$ are referred to when the digital drive device 33 stores the color image data signals $\phi d$ in its internal memory. In response to the reset signals $\phi r$, the digital drive device 33 resets the data stored in its internal memory.

The above four signals $\phi m$, $\phi d$, $\phi a$, and $\phi r$ are synchronous with one another. The image formation section 54 receives specific color light output from the rotary color filter 52 and produces the corresponding color image light La in response to the color image data signal $\phi d$ of the specific color light.

The digital drive device 33 and the control circuit 55 of this embodiment correspond to the digital drive apparatus of the present invention.

The projection lens 56 sequentially projects the respective color image lights La emitted from the image formation section 54 on a screen SC. The corresponding color images are mixed in the time course to reproduce a multi-color resulting image on the screen SC.

As mentioned above, the image display apparatus 50 of the embodiment reproduces multi-color images according to the color sequential technique. In the color sequential system, each light modulating element generally corresponds to each pixel, which enables multi-color reproduction. Compared with the prior art color filter system, the color sequential system advantageously yields images of higher resolution. Another advantage of the color sequential system is to attain the total size reduction of the image display apparatus, compared with the prior art three panel system and color filter system. The color sequential technique does not lead to partial updating of color images in either an interlace or non-interlace manner, thus effectively preventing the occurrence of flicker and advantageously ensuring display of high-quality images.

Figure 2A:
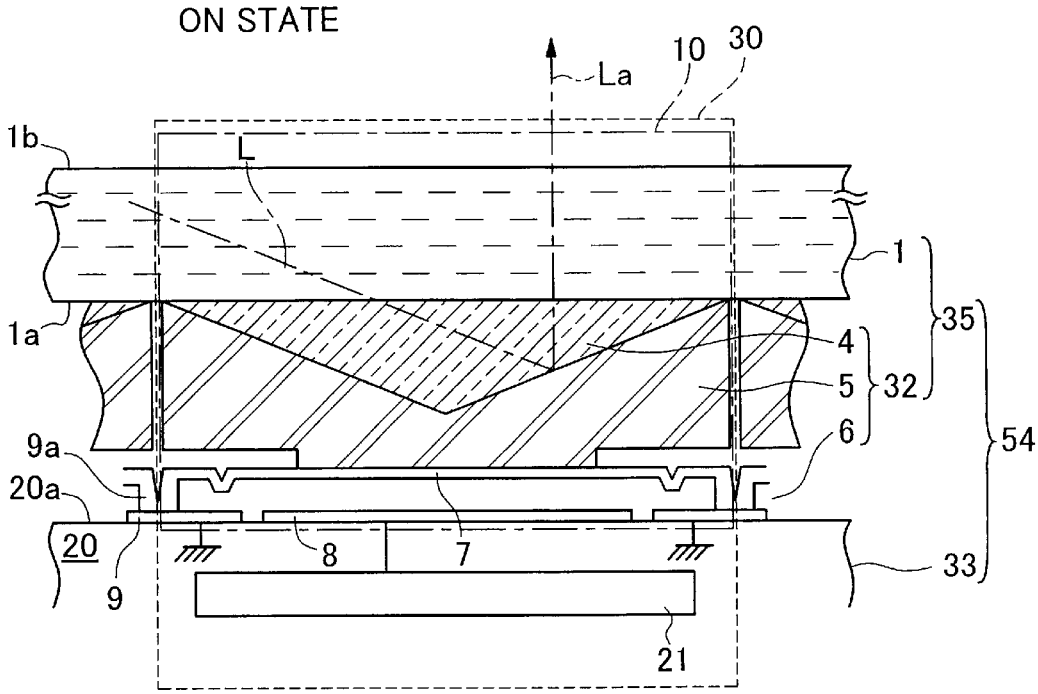
FIGS. 2(A) and 2(B) are enlarged view illustrating the image formation section 54 of FIG. 1.
Figure 2B:
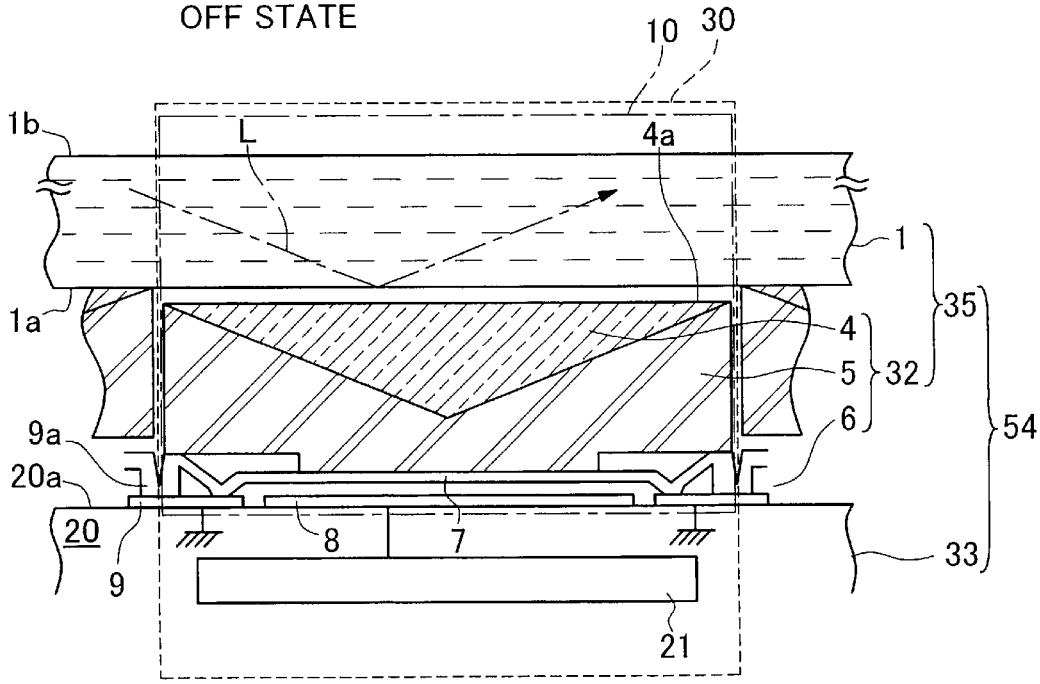

A-2. Image Formation Section:

FIGS. 2(A) and 2(B) are enlarged view illustrating the image formation section 54 of FIG. 1. In the structure of the embodiment, the light modulation device 35 is mounted on the digital drive device 33, so that the image formation section 54 is integrated on one chip. In a more concrete configuration, the switching section 32 is directly mounted on the digital drive device 33, and the light guiding plate 1 is placed upon the switching section 32. The digital drive device 33 functions as an image memory device (semiconductor memory device) manufactured on a semiconductor substrate 20.

The image formation section 54 includes a plurality of pixel formation sections 30 that are arranged in a matrix. One pixel formation section 30 that forms one pixel is illustrated in FIGS. 2(A) and 2(B). As discussed later, FIGS. 2(A) and 2(B) respectively express ON state and OFF state of the pixel formation section 30.

Each pixel formation section 30 includes a light modulation element (optical switching element) 10 and a memory cell (digital storage unit) 21. Each light modulation element 10 includes the light guiding plate 1 and the switching section 32.

The light guiding plate 1 is a transmissive plate member. The light guiding plate 1 by itself functions as a light guiding path (light guide) that totally reflects and propagates color light L. In a concrete mechanism, the color light L enters the light guiding plate 1 at a specific angle that allows total internal reflection of the color light L by a lower plane 1*a* of the light guiding plate 1. The color light L is totally reflected by the lower plane 1*a* and an upper plane 1*b* in an iterative manner and is propagated within the light guiding plate 1 without any loss. Accordingly the light guiding plate 1 by itself enables the color light L to be trapped in between the two planes of total internal reflection 1*a* and 1*b*.

In the vicinity of the planes of total internal reflection 1*a* and 1*b* of the light guiding plate 1, the color light L once leaks off the light guiding plate 1 by a very little distance and again returns into the light guiding plate 1. The light leaking off the planes of total internal reflection 1*a* and 1*b* is referred to as the evanescent wave. The evanescent wave leaks off the plane of total internal reflection by a distance close to the wavelength of the light. A proximate optical member at a position apart from the plane of total internal reflection by a distance of not greater than approximately the wavelength of the light enables extraction of the evanescent wave. The light modulation elements 10 of the embodiment are evanescent light switching devices (ESD) that switch on and off the light by utilizing the evanescent wave. In a concrete mechanism, each light modulation element 10 modulates (switches on and off) the color light propagated in the light guiding plate 1 at a relatively high speed through contact and separation of the upper surface of the switching section 32 with and from the lower plane 1*a* of the light guiding plate 1.

The switching section 32 includes a reflecting prism (micro-prism) 4, a support structure 5 that supports the reflecting prism 4, and an actuator section 6.

The reflecting prism 4 is a translucent member of a V-shaped cross section and has an extraction plane (contact plane) 4*a* that is substantially parallel to the lower plane 1*a* of the light guiding plate 1. As illustrated in FIG. 2(A), contact of the extraction plane 4*a* with the plane of total internal reflection 1*a* enables the reflecting prism 4 to extract the evanescent wave. The reflecting prism 4 reflects the extracted evanescent wave at an interface between the reflecting prism 4 and the support structure 5. A reflected light La is emitted in a direction practically perpendicular to the lower plane 1*a* of the light guiding plate 1.

The actuator section 6 electrostatically actuates the support structure 5 that supports the reflecting prism 4. The actuator section 6 includes an upper electrode 7 that is mechanically linked with the support structure 5, and a lower electrode 8 that is opposite to the upper electrode 7. Anchor plates 9 of the upper electrode 7 and the lower electrode 8 are mounted on an upper most surface 20*a* of the semiconductor substrate 20. The upper electrode 7 is held by support columns 9*a* that extend upward from the anchor plates 9. This forms a space between the upper electrode 7 and the lower electrode 8. The upper electrode 7 partially has the function of an elastic member.

The potential of the upper electrode 7 is set to the ground potential via the support columns 9*a* and the anchor plates 9. The potential of the lower electrode 8 is set by the memory cell 21. Namely the potential of the lower electrode 8 varies according to the output of the memory cell 21. The upper electrode 7 moves up and down by means of the electrostatic force acting in between the two electrodes 7 and 8.

When the setting of the potential of the lower electrode 8 is substantially equal to the potential of the upper electrode 7, the upper electrode 7 is apart from the lower electrode as shown in FIG. 2(A). In this state, the extraction plane 4*a* of the reflecting prism 4 is in contact with the lower plane 1*a* of the light guiding plate 1. The color light L is then emitted upward in the drawing by means of the reflecting prism 4. Namely when the potential of the lower electrode 8 is set substantially equal to the ground potential, the light modulation element 10 included in the pixel formation section 30 is set in the ON state that allows emission of light.

When the setting of the potential of the lower electrode 8 is relatively higher than the potential of the upper electrode 7, on the contrary, the upper electrode 7 is deflected downward to be located closer to the lower electrode 8 as shown in FIG. 2(B). In this state, the extraction plane 4*a* of the reflecting prism 4 is apart from the lower plane 1*a* of the light guiding plate 1. The color light L is then totally reflected from the lower plane 1*a* of the light guiding plate 1 and propagated in the light guiding plate 1. Namely when the potential of the lower electrode 8 is set to a high level, the light modulation element 10 included in the pixel formation section 30 is set in the OFF state that prohibits emission of light.

The memory cell 21 specifies the potential of the lower electrode 8 included in the actuator section 6 according to the color image data signal ϕd supplied from the control circuit 55 shown in FIG. 1, thereby controlling the on/off operations of the light modulation element 10.

As described above, the pixel formation section 30 includes the light modulation element 10 that is controllable by the memory cell 21. The light modulation element 10 causes the color light L to be emitted upward in the drawing according to the output state of the memory cell 21. The image formation section 54 uses the color light L with regard to the respective pixels emitted from the respective pixel formation sections 30 and thus generates the color image light La corresponding to the composite color light L.

In this embodiment, ESDs are used for the light modulation elements 10. The ESD switches light on and off in response to movement of a distance of even submicron order and thus exhibits a relatively quick response. The ESD also ensures substantially complete light switching on and off operations. Accordingly the image display apparatus 50 of the embodiment enables display of images having multiple tones and striking contrast.

Figure 3:
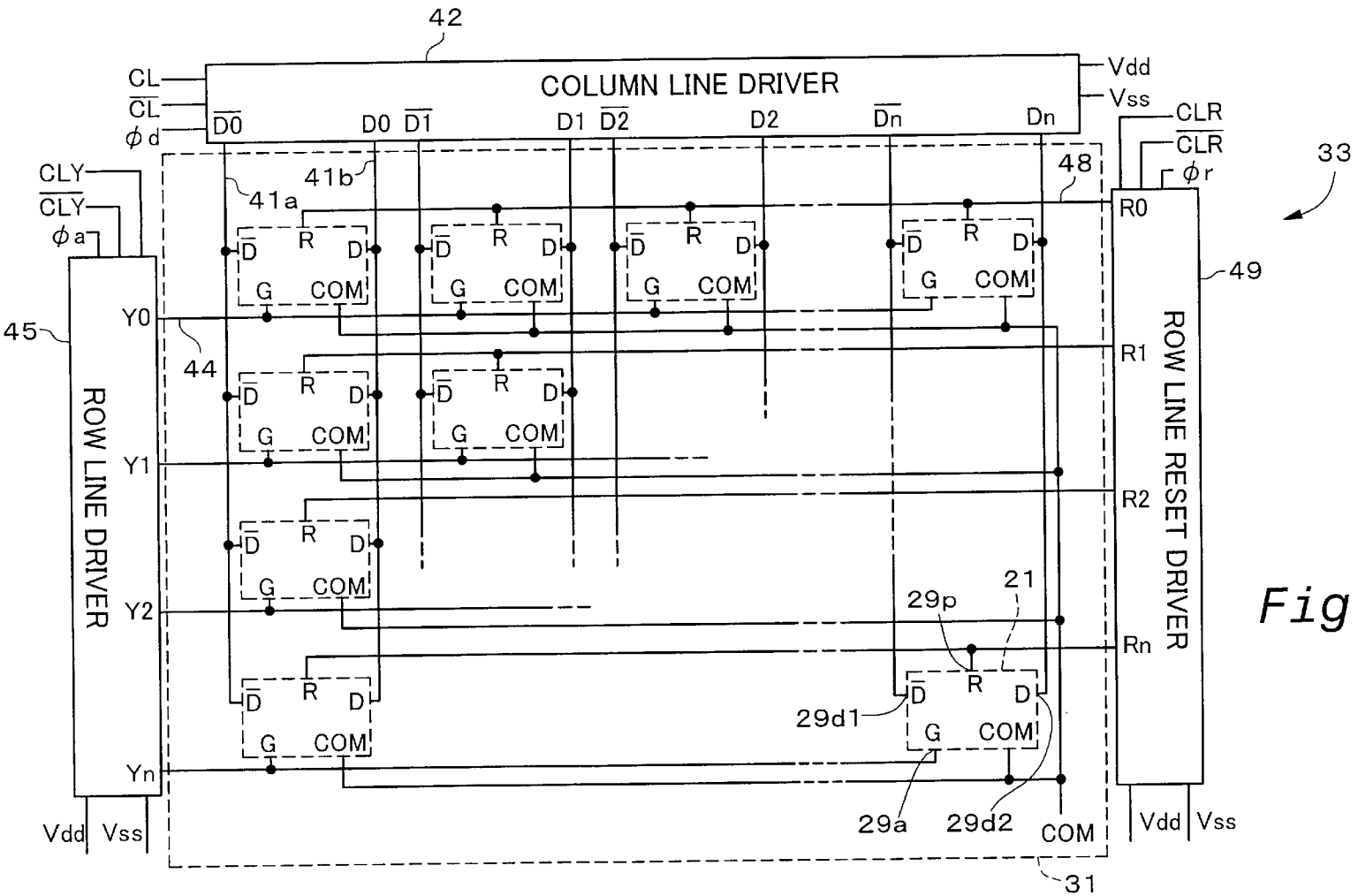
FIG. 3 is a block diagram illustrating the internal structure of the digital drive device 33 of FIG. 1.

A-3. Digital Drive Device:

FIG. 3 is a block diagram illustrating the internal structure of the digital drive device 33 of FIG. 1. The digital drive device 33 is formed on the semiconductor substrate 20 (FIGS. 2(A) and 2(B)), and includes a memory cell array (digital storage device) 31, a row line driver 45, a column line driver 42, and a row line reset driver 49. The drivers 45, 42, and 49 respectively receive the signals ϕa, ϕd, and ϕr transmitted from the control circuit 55 shown in FIG. 1, as well as clock signals CLY (#CLY), CL (#CL), and CLR (#CLR).

In the specification hereof, the signal with '#' as the prefix of the symbol corresponds to the signal with the over-bar drawn over the symbol. These signals with '#' or the over-bar represent the signals of inverted logic level, relative to the signals without '#' or the over-bar.

The memory cell array 31 includes a plurality of the memory cells 21 (FIGS. 2(A) and 2(B)) that are arranged in a two-dimensional matrix (array) and stores color image data for one picture screen. Each of the memory cells 21 has a pair of data terminals 29*d*1 and 29*d*2, an address terminal 29*a*, a reset terminal 29*p*, and a non-illustrated output terminal. The output terminal of each memory cell 21 is connected to the lower electrode 8 in each pixel formation section 30 as shown in FIGS. 2(A) and 2(B).

The memory cell array 31 also includes a plurality of address lines (first signal lines) 44 connecting with the row line driver (first driver circuit) 45, plural pairs of data lines (second signal lines) 41*a*, 41*b* connecting with the column line driver (second driver circuit) 42, and a plurality of reset lines (third signal lines) 48 connecting with the row line reset driver (third drive circuit) 49. Each address line 44 connects a set of address terminals 29*a* in parallel, which are included in one set of memory cells aligned in the direction of rows (first direction). Each pair of data lines 41*a*, 41*b* connect a set of data terminal pairs 29*d*1, 29*d*2 in parallel, which are included in one set of memory cells aligned in the direction of columns (second direction that is perpendicular to the first direction). Each reset line 48 connects a set of reset terminals 29*p* in parallel, which are included in one set of memory cells aligned in the direction of rows (first direction).

Figure 4:
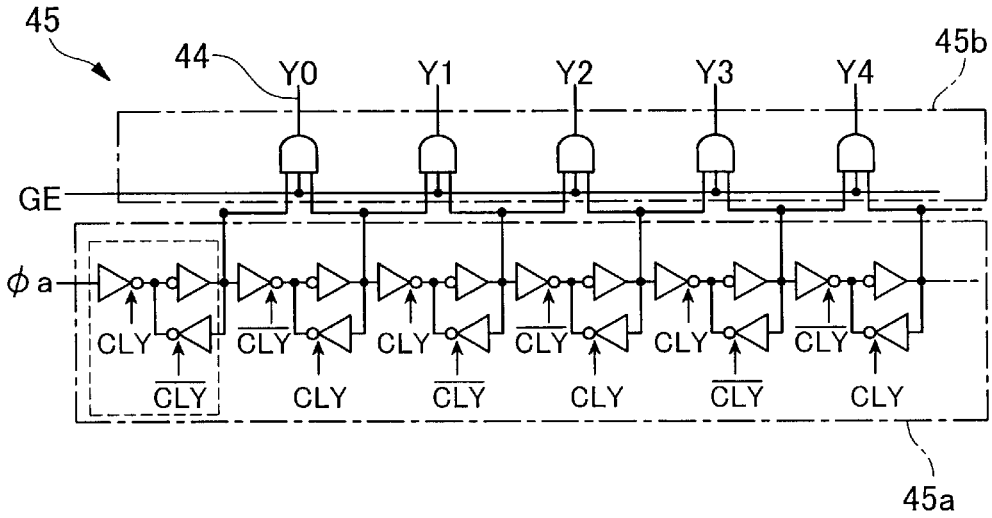
FIG. 4 is a block diagram illustrating the internal structure of the row line driver 45 of FIG. 3 as an example.

The row line driver 45 supplies an address signal (scanning signal) Y sequentially from the top to the bottom in the drawing to each set of memory cells aligned in the direction of rows via each address line 44. FIG. 4 is a block diagram illustrating the internal structure of the row line driver 45 of FIG. 3 as an example. The row line driver 45 has a shift register circuit 45*a* that includes a plurality of registers, each consisting of three inverters, and an AND logic circuit 45*b* that includes a plurality of AND gates. The shift register circuit 45*a* has the function of serial-to-parallel conversion. A pulse of the address signal ϕa given to a first register is successively transferred to second and subsequent registers in response to the clock signals CLY and #CLY and is output from each register. Each AND gate in the AND logic circuit 45*b* outputs a logical product of data supplied from adjoining two registers as the address signal Y. The AND logic circuit 45*b* accordingly outputs the address signal Y having a relatively high time-based resolution, that is, the address signal Y set at a level H only for a short time period when the address signal ϕa is shifted in response to the clock signals CLY and #CLY (half the period of the clock signals CLY and #CLY). In the row line driver 45 of this embodiment, an enable signal GE is supplied to each AND gate to mask the output of the address signal Y.

Figure 5:
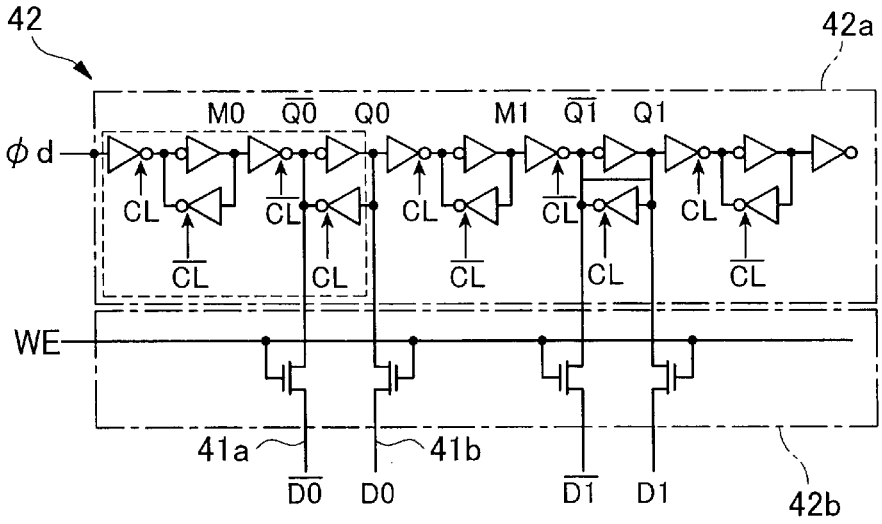
FIG. 5 is a block diagram illustrating the internal structure of the column line driver 42 of FIG. 3 as an example.

The column line driver 42 supplies a pair of data signals D and #D simultaneously to each set of memory cells aligned in the direction of columns via each pair of data lines 41*a* and 41*b*. FIG. 5 is a block diagram illustrating the internal structure of the column line driver 42 of FIG. 3 as an example. The column line driver 42 has a shift register circuit 42*a* that includes a plurality of registers, each consisting of six inverters, and an analog switch circuit 42*b* that includes plural pairs of switches. The shift register circuit 42*b* has the function of serial-to-parallel conversion. The color image data signal ϕd given to a first register is successively transferred to second and subsequent registers and is output from each register. Each pair of switches in the analog switch circuit 42*b* regulate the output timings of the pair of data signals D and #D in response to an enable signal WE supplied to the respective gates. The enable signal WE works to accurately specify the output timings of the pair of data signals D and #D to the pair of data lines 41*a* and 41*b*.

Figure 6:
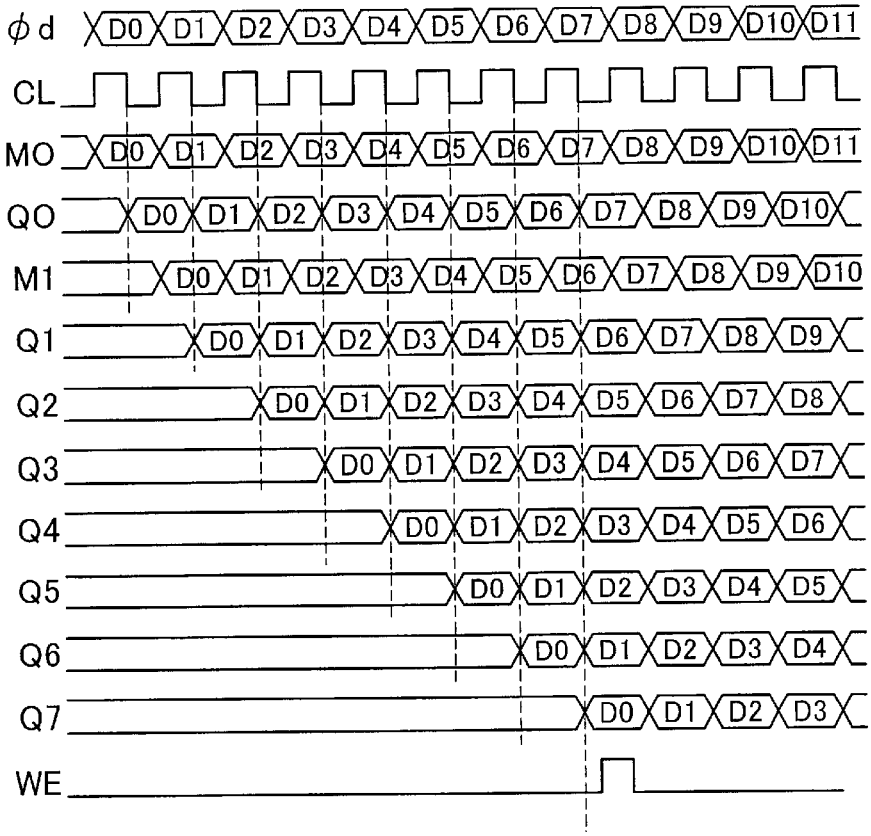
FIG. 6 is a timing chart showing the operations of the column line driver 42 of FIG. 5.

FIG. 6 is a timing chart showing the operations of the column line driver 42 of FIG. 5. As illustrated, the respective registers, each consisting of six inverters (FIG. 5), successively transfer data at falling edges of the clock signal CL. Outputs Q and #Q of the respective registers are supplied as the data signals D and #D to the data lines 41*a* and 41*b* when the enable signal WE is set at the level H.

When the enable signal WE is set at the level H, the address signal Y of the level H is supplied to one row of memory cells, which should receive the data signals D and #D. Each memory cell 21 thus stores data in the state free from the occurrence of cross talk.

Figure 7:
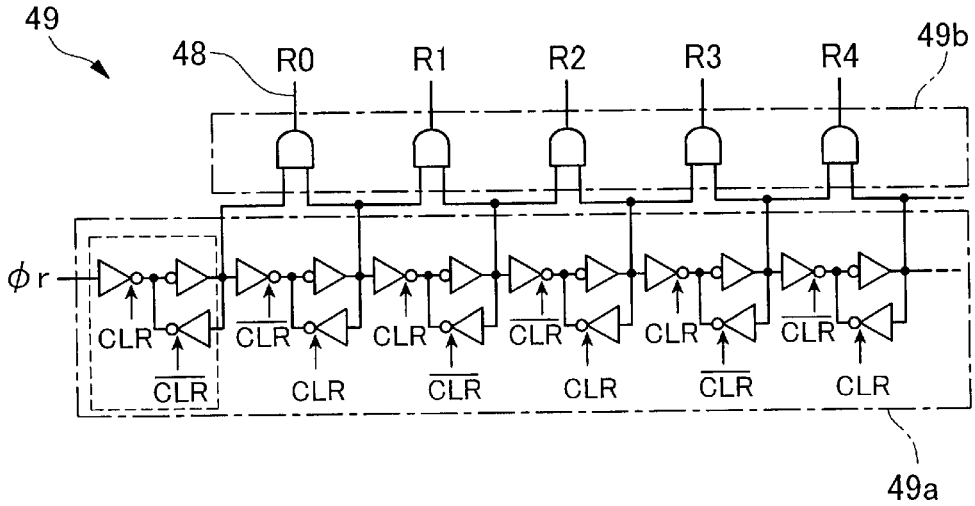
FIG. 7 is a block diagram illustrating the internal structure of the row line reset driver 49 of FIG. 3 as an example.

The row line reset driver 49 supplies a reset signal R sequentially from the top to the bottom in the drawing to each set of memory cells aligned in the direction of rows via each reset line 48. FIG. 7 is a block diagram illustrating the internal structure of the row line reset driver 49 of FIG. 3 as an example. The row line reset driver 49 has a shift register circuit 49*a* that includes a plurality of registers, each consisting of three inverters, and an AND logic circuit 49*b* that includes a plurality of AND gates. The shift register circuit 49*a* and the AND logic circuit 49*b* are substantially similar to the corresponding circuits 45*a* and 45*a*. The AND logic circuit 49*b* outputs the reset signal R having a relatively high time-based resolution, that is, the reset signal R set at a level H only for a short time period when the reset signal ϕr is shifted in response to the clock signals CLY and #CLY (half the period of the clock signals CLY and #CLY).

Each memory cell 21 controls the operations of each light modulation element 10 (FIGS. 2(A) and 2(B)) in response to the signals Y, D, #D, and R supplied from the three drivers 45, 42, and 49.

Figure 8:
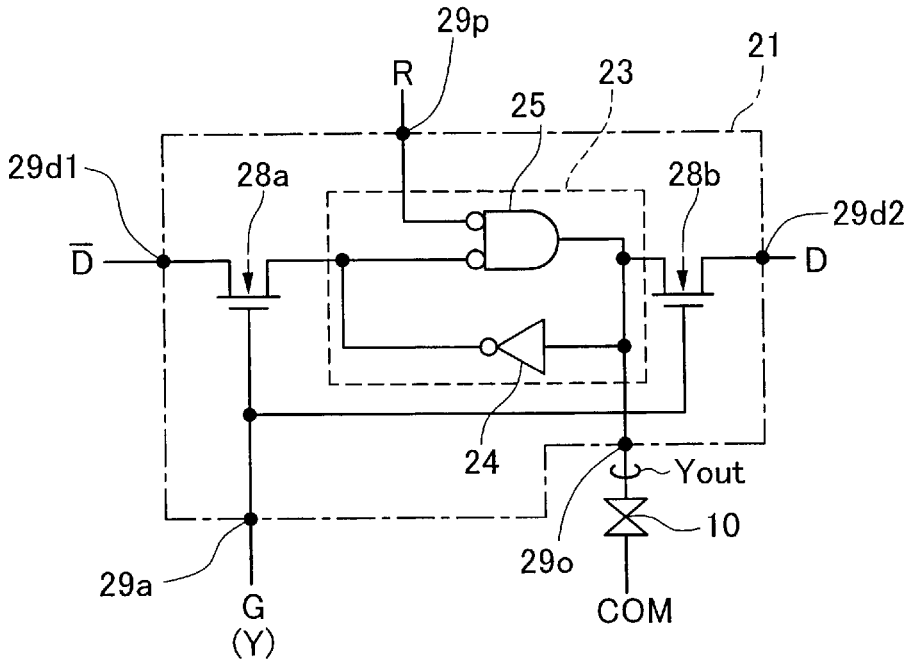
FIG. 8 is a block diagram illustrating the internal structure of each memory cell 21 of FIG. 3 as an example.

FIG. 8 is a block diagram illustrating the internal structure of each memory cell 21 of FIG. 3 as an example. The memory cell 21 includes a storage section 23 and two transfer elements (hereinafter also be referred to as switching elements) 28*a* and 28*b* for transferring data to the storage section 23.

The storage section 23 has an inverter 24 and a 2-input NOR gate 25 of negative logic. The inverter 24 and the NOR gate 25 are connected with each other to form a loop. In a concrete configuration, an input terminal of the inverter 24 connects with an output terminal of the NOR gate 25. One input terminal of the NOR gate 25 connects with an output terminal of the inverter 24, whereas the other input terminal of the NOR gate 25 connects with the reset terminal 29*p*. Namely the memory cell 21 is constructed as an SRAM circuit including two transfer elements and loop-connecting two inverters. This arrangement simplifies the construction of the storage section 23.

The two switching elements 28*a* and 28*b* are transistors (active elements) of CMOS. The address signal Y supplied from the address terminal 29*a* controls the on-off operations of the two switching elements 28*a* and 28*b*. The first switching element 28*a* is connected to the first data terminal 29*d*1 and the output terminal of the inverter 24. The second switching element 28*b* is connected to the second data terminal 29*d*2 and the input terminal of the inverter 24.

Data are stored into the storage section 23 in the following manner. The address signal Y of the level H supplied from the address terminal 29*a* closes the switching elements 28*a* and 28*b*, and data are written into the storage section 23 according to the data signals D and #D supplied via the data terminals 29*d*1 and 29*d*2. The storage section 23 keeps the data written therein while the switching elements 28*a* and 28*b* are open.

The output terminal of the NOR gate 25 is connected with an output terminal 29*o* of the memory cell 21. An output signal Yout of the NOR gate 25 is thus supplied to the light modulation element 10 via the output terminal 29*o*. Namely the data stored in the storage section 23 regulates the operations of the light modulation element 10.

The storage section 23, which stores data therein, is reset in response to the reset signal R of the level H transmitted to the reset terminal 29*p*. At this state, the output of the storage section 23 is set in a predetermined state, irrespective of the data previously stored therein. Accompanied with the resetting operation of the storage section 23, the light modulation element 10 is also reset to a predetermined state.

In the memory cell 21 of FIG. 8, according to the supply of the reset signal R of the level H to the storage section 23, the output signal Yout of a level L (low potential) is output from the output terminal 29*o*. In this case, the light modulation element 10 is accordingly set in the ON state shown in FIG. 2(A). In the following explanation, however, for the simplicity of discussion, it is assumed that the light modulation element 10 is set in the OFF state according to the resetting operation of the storage section 23.

Figure 9:
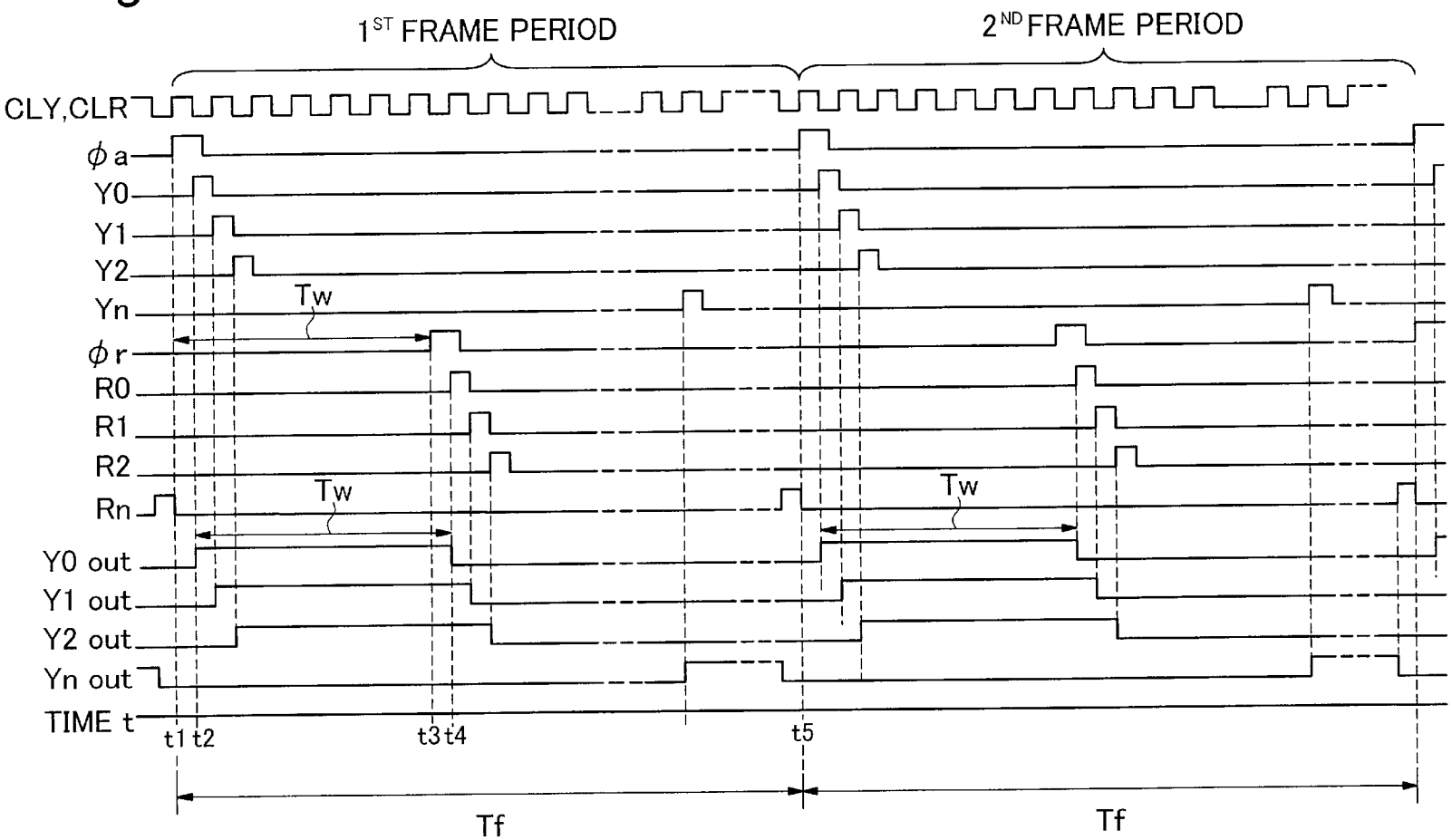
FIG. 9 is a timing chart showing the operations of the digital drive device 33 of FIG. 3.

FIG. 9 is a timing chart showing the operations of the digital drive device 33 of FIG. 3. In the image display apparatus 50 that adopts the color sequential technique, in order to display a multi-color image on the screen SC, it is required to rewrite each color image data stored in the memory cell array 31 with regard to each color light component L supplied to the image formation section 54. During a period when one color light component is supplied to the image formation section 54, color image data corresponding to the supplied color light component should be written into the memory cell array 31 and then the written color image data should be deleted. When the color image data written into the memory cell array 31 is deleted, that is, when the storage section 23 included in each memory cell 21 is reset, each corresponding light modulation element 10 in the image formation section 54 is set in the OFF state that prohibits emission of light as the presumption given above.

At a time point t1, the address signal ϕa, which specifies start of a first frame period, is output from the control circuit 55 to the row line driver 45. In the first frame period, the rotary color filter 52 (FIG. 1) supplies a first color light component to the image formation section 54 in response to the motor control signal ϕm output from the control circuit 55 to the motor 53. The row line driver 45 sequentially transmits the address signals Y to sets of memory cells on the respective rows via the plurality of address lines 44, in response to the address signal ϕa. For example, at a time point t2, an address signal Y0 is given to a set of memory cells on the first row via the first address line 44. The set of memory cells on each row, which has received the address signal Y, latches the data signals D and #D transmitted via each pair of data lines 41*a* and 41*b*. Each memory cell 21 transmits the output signal Yout according to the data stored therein. Each light modulation element 10 is set in the ON state when the output signal Yout is at the level H.

At a time point t3 when a preset time period Tw has elapsed since the time point t1, the reset signal ϕr is output from the control circuit 55 to the row line reset driver 49. The row line reset driver 49 sequentially transmits the reset signals R to sets of memory cells on the respective rows via the plurality of reset lines 48, in response to the reset signal ϕr. Namely the row line reset driver 49 supplies the reset signals R to the sets of memory cells on the respective rows at predetermined timings after the row line driver 45 supplies the address signals Y to the sets of memory cells on the respective rows. For example, at a time point t4 when the preset time period Tw has elapsed since the time point t2, a reset signal R0 is given to a set of memory cells on the first row via the first reset line 48. The set of memory cells on each row, which has received the reset signal R, is forcibly reset. In this state, each memory cell 21 transmits the output signal Yout of the level L, and each light modulation element 10 is set in the OFF state.

The similar procedures are carried out in a second frame period starting at a time point t5. In the second frame period, the rotary color filter 52 supplies a second color light component to the image formation section 54.

As discussed above, the digital drive device 33 of this embodiment enables color image data to be rewritten in one frame period Tf. In accordance with a concrete procedure, the digital drive device 33 causes the address signals Y and the reset signals R to be output to the row line driver 45 and the row line reset driver 49 in one frame period Tf, in response to the address signal ϕa and the reset signal ϕr output from the control circuit 55. Since the address signals Y and the reset signals R are given to the respective memory cells 21 in one frame period Tf, color image data corresponding to a color light component are written into the memory cell array 31 and are then deleted during one frame period Tf. This arrangement enables the image formation section 54 to emit a color image light La corresponding to the supplied color light component L in each frame period. Different color images are thus displayed on the screen SC in different frame periods.

Figure 10:
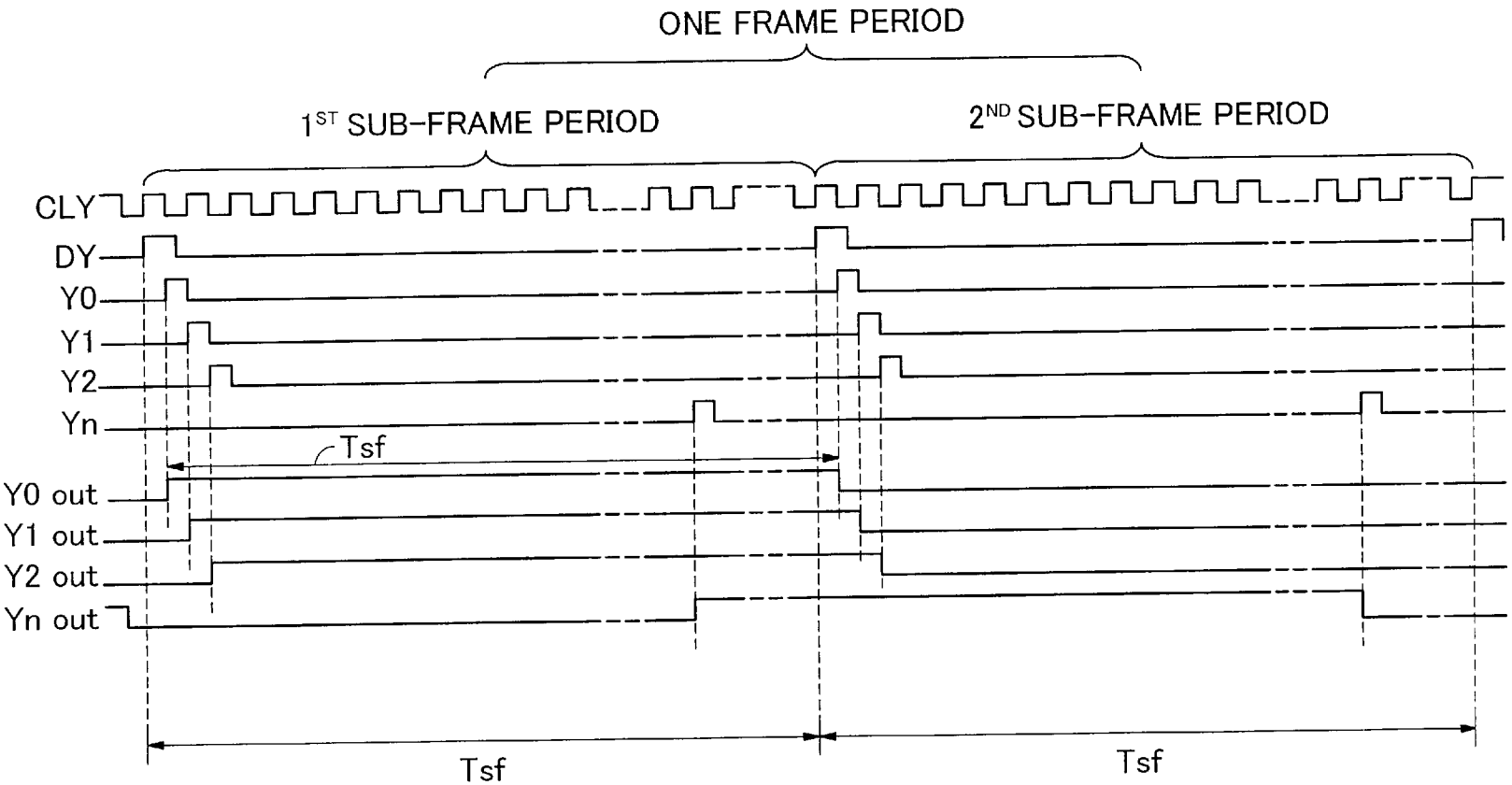
FIG. 10 is a timing chart showing the operations of a prior art digital drive device.

FIG. 10 is a timing chart showing the operations of a prior art digital drive device. In the prior art digital drive device, each memory cell does not have a reset terminal nor a reset function. One frame period that corresponds to a color image of one picture screen accordingly includes two sub-frame periods as described previously. In the first sub-frame period, the address signals Y are sequentially transmitted to sets of memory cells on the respective rows via plurality of address lines. The set of memory cells on each row, which has received the address signal Y, latches the data signals. Each memory cell 21 transmits the output signal Yout according to the data stored therein, and each light modulation element is set in the ON state in response to the output signal Yout of the level H. In the second sub-frame period, the address signals Y are again sequentially transmitted to sets of memory cells on the respective rows via the plurality of address lines. The set of memory cells on each row, which has again received the address signal Y, stores a supply of data representing the reset state. In this state, each memory cell transmits the output signal Yout of the level L that corresponds to the reset state, and each light modulation elements is set in the OFF state.

As clearly understood from the comparison between FIG. 9 and FIG. 10, the image formation section 54 of this embodiment does not require iterative scans of the address signal Y to display a color image of one picture screen, unlike the prior art system. Namely the image formation section 54 of the embodiment enables a color image of one picture screen to be displayed according to every scan of the address signal Y. In the memory cell 21 of this embodiment, the storage section 23 may forcibly be reset without supplying the address signal again to each memory cell to store data corresponding to the reset state in the memory cell. The digital drive device 33 of the embodiment may rewrite the color image data at a relatively high speed, thus shortening each frame period Tf. This arrangement improves the time-based resolution for displaying the color image to a relatively high level, and thereby ensures display of images having a greater number of tones.

In the prior art digital drive device, the ON period of the light modulation element is set equal to one sub-frame period Tsf. The digital drive device of the present embodiment, on the other hand, the preset time period Tw may be varied to an appropriate time in one frame period Tf. The row line reset driver 49 thus transmits the reset signals R to sets of memory cells on the respective rows at desired timings after the row line driver 45 transmits the address signals Y to the sets of memory cells on the respective rows. This results in regulating the light emission time Tw of the light modulation element, thereby adjusting the brightness of the color image. For example, setting a relatively large value to the preset time period Tw enhances the utilization efficiency of light in the image formation section 54, thus enabling a brighter image to be displayed.

In the timing chart of FIG. 9, the reset signals R are output when the preset time period Tw has elapsed since the output of the corresponding address signals Y in both the first and the second frame periods. The preset time period Tw may be varied in each frame period. For example, a relatively large value may be set to the preset time period Tw in specific frame periods that use a specific color light component out of the three color light components emitted from the rotary color filter 52. This arrangement enables the image display apparatus 50 to regulate the brightness for each color image and thus readily adjust the color balance of the resulting multi-color image.

Figure 11:
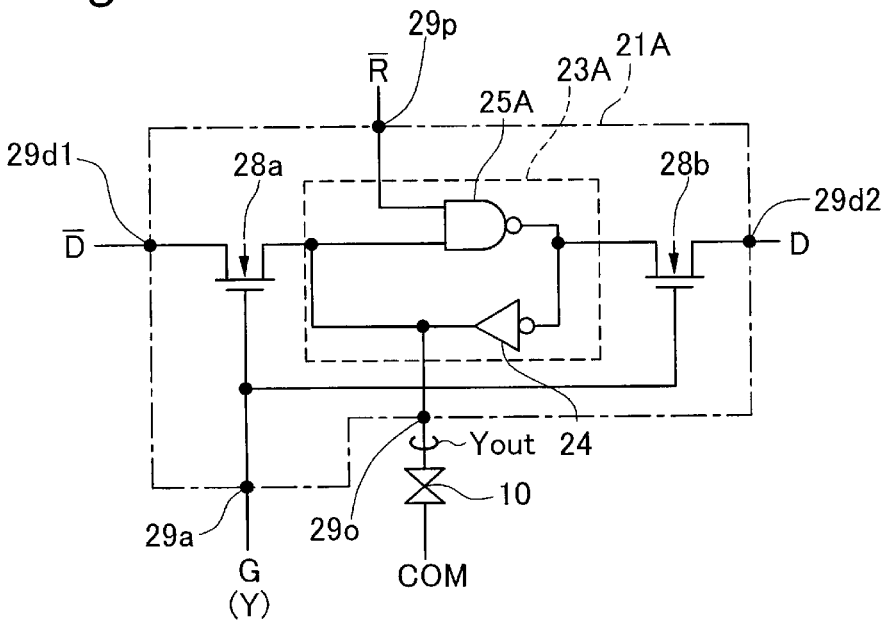
FIG. 11 is a block diagram illustrating a first modified example of the memory cell 21 (FIG. 8)

A-4. Modifications:

FIG. 11 is a block diagram illustrating a first modified example of the memory cell 21 (FIG. 8). The memory cell 21A shown in FIG. 11 has a similar configuration to that of FIG. 8, except that a storage section 23A includes the inverter 24 and a 2-input NAND gate 25A that are connected to each other to form a loop. The output terminal of the inverter 24 connects with the output terminal 29*o* of a memory cell 21A. In this memory cell 21A, the reset terminal 29*p* connects with an input terminal of the NAND gate 25A, so that the storage section 23A is reset in response to supply of a reset signal #R of the level L. The output signal Yout of the level L is transmitted according to the resetting operation of the storage section 23A.

Figure 12:
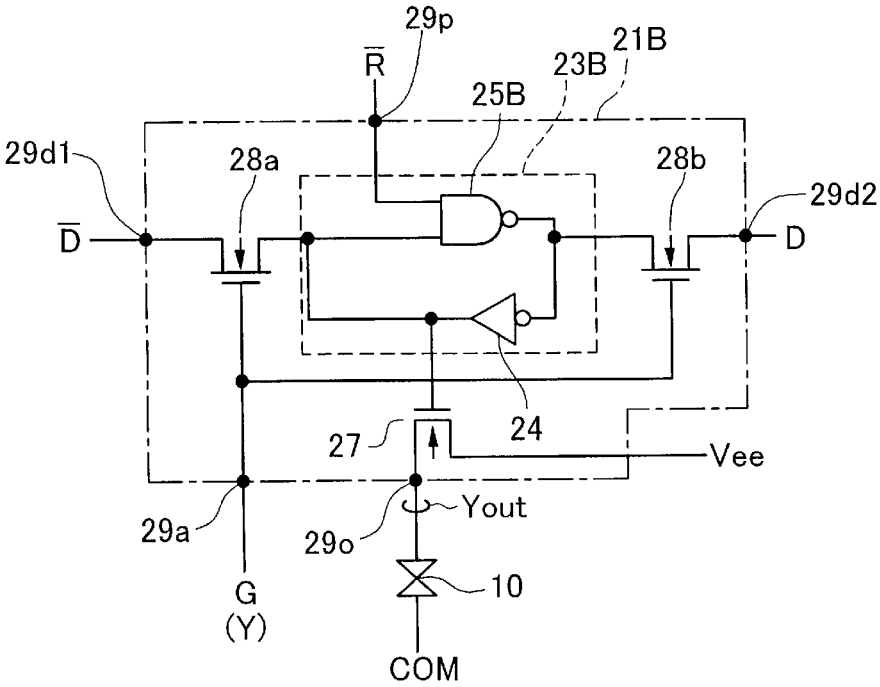
FIG. 12 is a block diagram illustrating a second modified example of the memory cell 21 (FIG. 8)

FIG. 12 is a block diagram illustrating a second modified example of the memory cell 21 (FIG. 8). The memory cell 21B shown in FIG. 12 has a similar configuration to that of FIG. 11, and a storage section 23B includes the inverter 24 and a 2-input NAND gate 25B that are connected to each other to form a loop. The output terminal of the inverter 24 in the storage section 23B connects with the output terminal 29*o* of a memory cell 21B via a buffer circuit 27 for voltage conversion. The use of the buffer circuit 27 enables each memory cell 21B to transmit the output signal of an arbitrary voltage level, while advantageously reducing the power consumption of the storage section 23B. This results in driving the light modulation element 10 at an arbitrary voltage level. The output signal Yout of the level L is transmitted when the storage section 23B is reset in response to supply of the reset signal #R of the level L.

Figure 13:
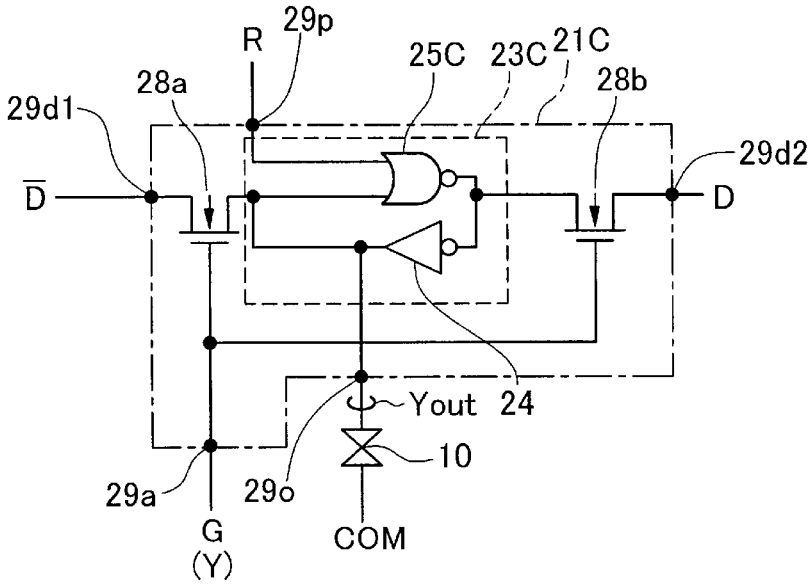
FIG. 13 is a block diagram illustrating a third modified example of the memory cell 21 (FIG. 8)

FIG. 13 is a block diagram illustrating a third modified example of the memory cell 21 (FIG. 8). The memory cell 21C shown in FIG. 13 has a similar configuration to that of FIG. 11, except that a storage section 23C includes the inverter 24 and a 2-input NOR gate 25C that are connected to each other to form a loop. In this memory cell 21C, the reset terminal 29*p* connects with an input terminal of the NOR gate 25C, so that the storage section 23C is reset in response to supply of the reset signal R of the level H. The output signal Yout of the level H is transmitted according to the resetting operation of the storage section 23C. This memory cell 21C is thus suitably applicable for the light modulation element 10 of FIGS. 2(A) and 2(B), which is set in the OFF state in the case of supply of the output signal Yout of the level H.

Figure 14:
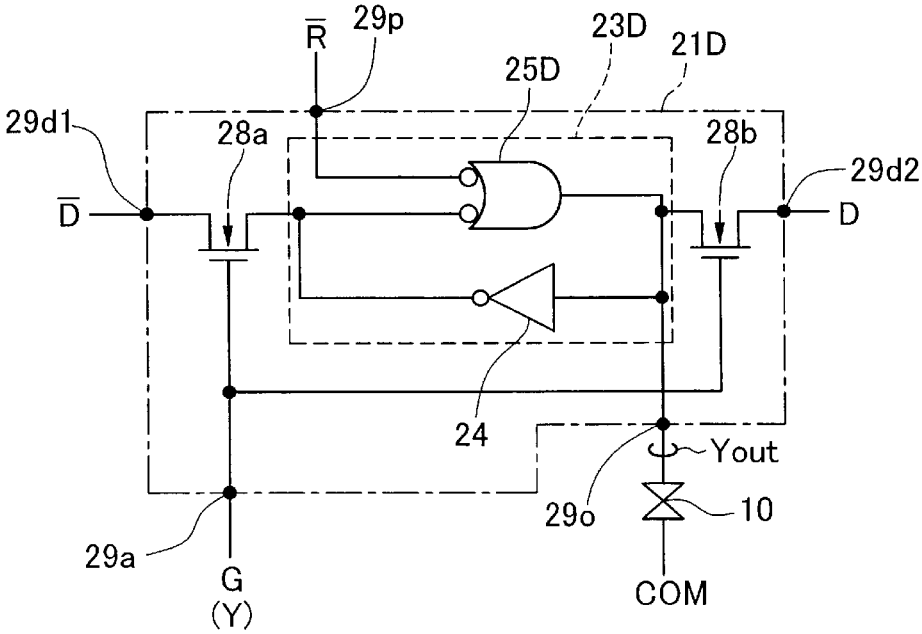
FIG. 14 is a block diagram illustrating a fourth modified example of the memory cell 21 (FIG. 8)

FIG. 14 is a block diagram illustrating a fourth modified example of the memory cell 21 (FIG. 8). The memory cell 21D shown in FIG. 14 has a similar configuration to that of FIG. 8, except that a storage section 23D includes the inverter 24 and a 2-input NAND gate 25D of negative logic, which are connected to each other to form a loop. In this memory cell 21D, the reset terminal 29*p* connects with an input terminal of the NAND gate 25D, so that the storage section 23D is reset in response to supply of the reset signal R of the level L. The output signal Yout of the level H is transmitted according to the resetting operation of the storage section 23D. This memory cell 21D is thus also suitably applicable for the light modulation element 10 of FIGS. 2(A) and 2(B), which is set in the OFF state in the case of supply of the output signal Yout of the level H.

Figure 15:
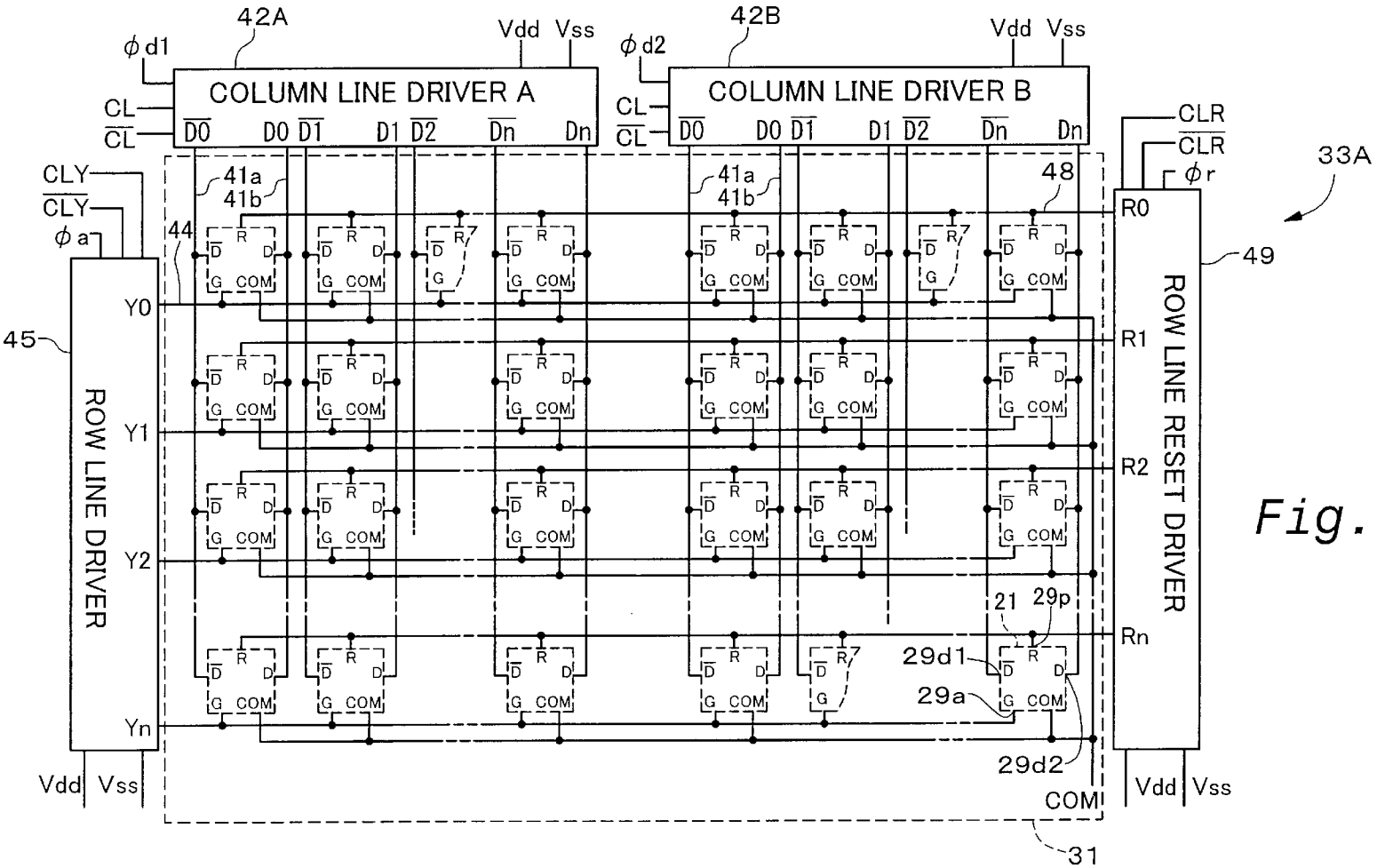
FIG. 15 is a block diagram illustrating a modified example of the digital drive device 33 (FIG. 3)

FIG. 15 is a block diagram illustrating a modified example of the digital drive device 33 (FIG. 3). The digital drive device 33A shown in FIG. 15 has a similar structure to that of FIG. 3, except that the column line driver comprises two partial column line drivers 42A and 42B. The two partial column line drivers 42A and 42B correspond to two divisions of the column line driver 42 shown in FIG. 3. The partial column line drivers 42A and 42B respectively receive color image data signals ϕd1 and ϕd2 and transmit the data signals D and #D to half the plurality of memory cells included in the memory cell array 31. This arrangement advantageously reduces the quantity of data that are subjected to serial-to-parallel conversion by each of the partial column line drivers 42A and 42B, thus enabling the data signals D and #D to be supplied to the respective memory cells 21 at a relatively high speed.

Although the structure of FIG. 15 uses two partial column drivers, three or any greater number of partial column drivers may be included in the structure. In general, each of plural partial driver circuits is required to supply data signals to at least part of plural memory cells. The digital drive device having a plurality of partial column drivers is suitably applied for an image display apparatus having a relatively high resolution.

As described above, the image display apparatus 50 of the embodiment includes the digital drive device 33 or 33A and the light modulation device 35. The digital drive device 33 or 33A has the memory cell array 31 including the plurality of memory cells 21 or any of 21A through 21D that are arranged in a matrix. Each memory cell 21 or any of 21A through 21D has the reset terminal 29*p*. This arrangement enables the output of the storage section 23 or any of 23A through 23D to be readily set in a predetermined state, regardless of the data previously stored in the storage section 23 or any of 23A through 23D. This results in readily setting the light modulation element 10 in a predetermined state.

The term 'reset' as the reset signal and the reset terminal in the specification hereof may be replaced with the term 'set' as the set signal and the set terminal. Namely the term 'reset' in the specification hereof is synonymous with the term 'set'.

Figure 16:
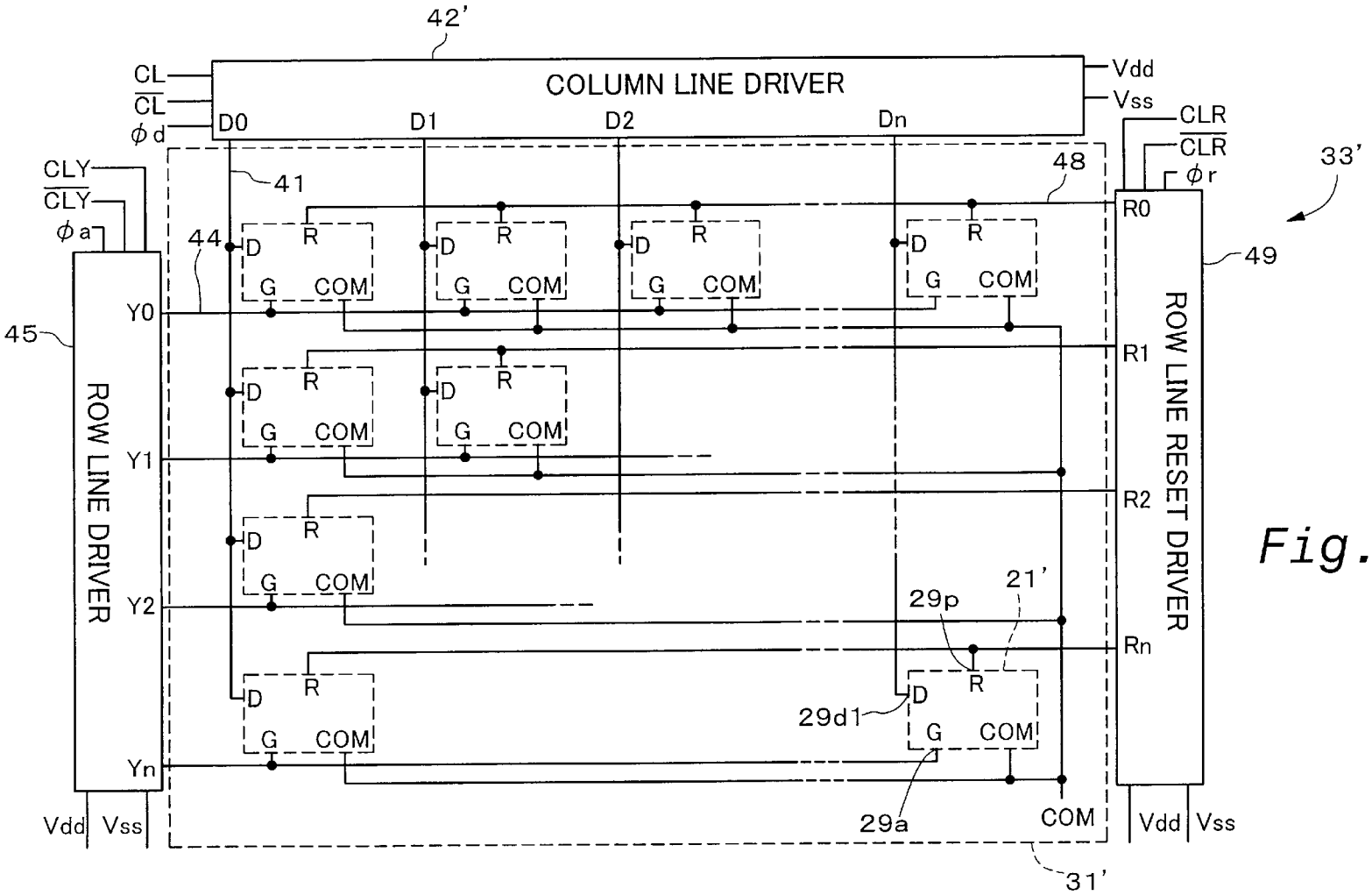
FIG. 16 is a block diagram illustrating the internal structure of a digital drive device 33' in a second embodiment.

B. Second Embodiment:

FIG. 16 is a block diagram illustrating the internal structure of a digital drive device 33' in a second embodiment. The digital drive device 33' of the second embodiment has a similar structure to that of the digital drive device 33 of the first embodiment (FIG. 3), except that each memory cell 21' included in a memory cell array 31' has only one data terminal 29*d*1. In the structure of the first embodiment, the column line driver 42 outputs the pair of data signals D and #D via the pair of data lines 41*a* and 41*b*, and each memory cell 21 latches the pair of data signals D and #D. In the structure of the second embodiment, on the other hand, a column line driver 42' outputs one data signal D via one data line 41, and each memory cell 21' latches the one data signal D.

Figure 17:
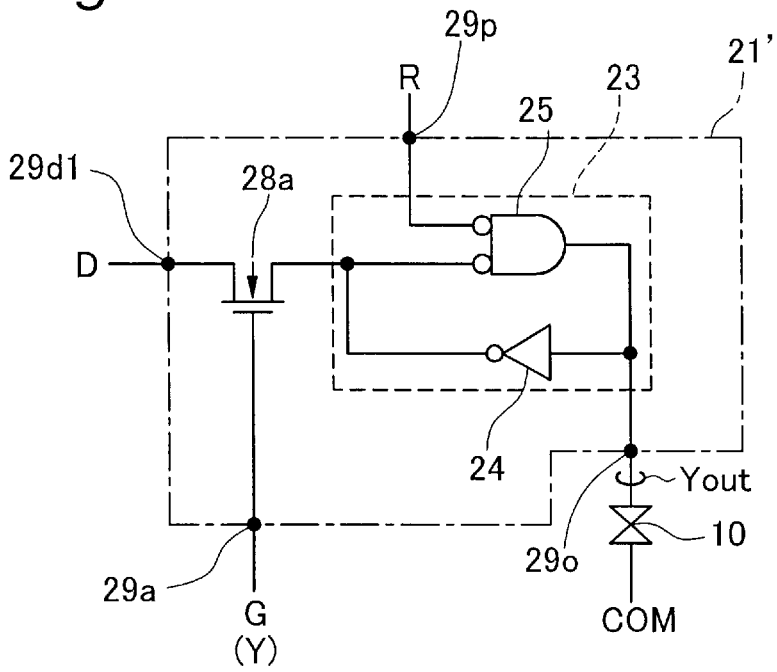
FIG. 17 is a block diagram illustrating the internal structure of each of the memory cells 21' shown in FIG. 16 as an example.
Figure 18:
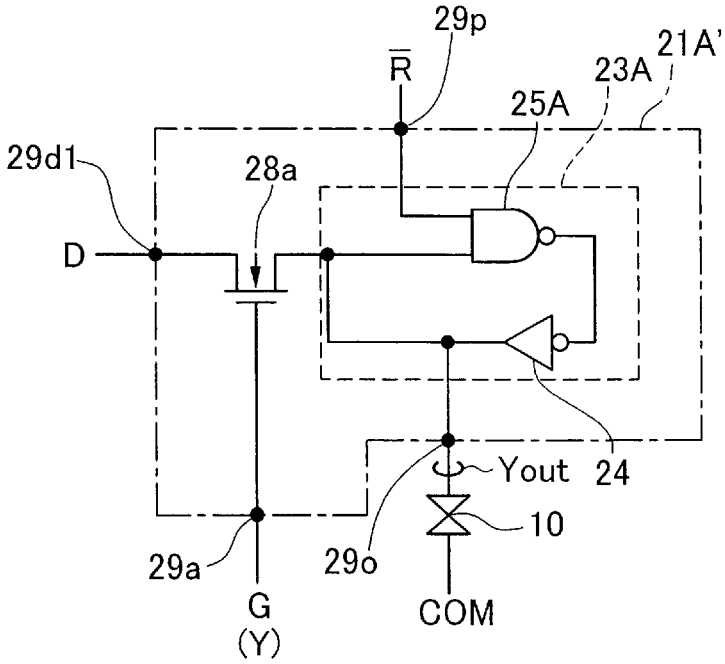
FIG. 18 is a block diagram illustrating a first modified example of the memory cell 21' (FIG. 17)
Figure 19:
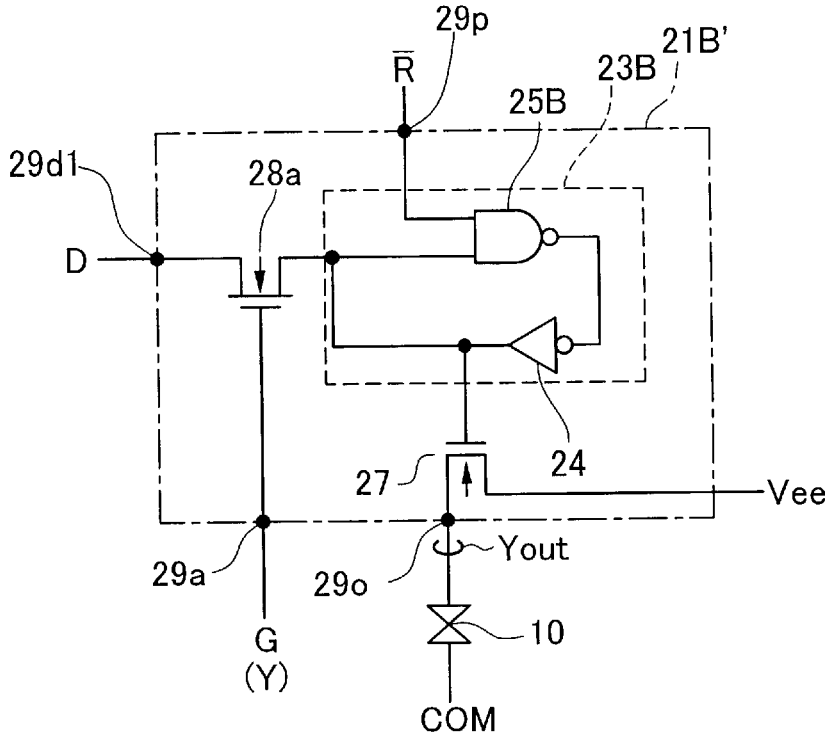
FIG. 19 is a block diagram illustrating a second modified example of the memory cell 21' (FIG. 17)
Figure 20:
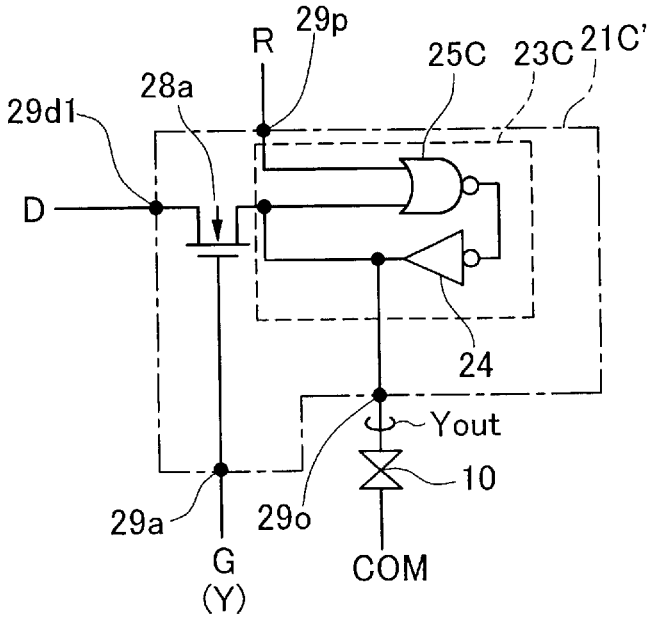
FIG. 20 is a block diagram illustrating a third modified example of the memory cell 21' (FIG. 17)
Figure 21:
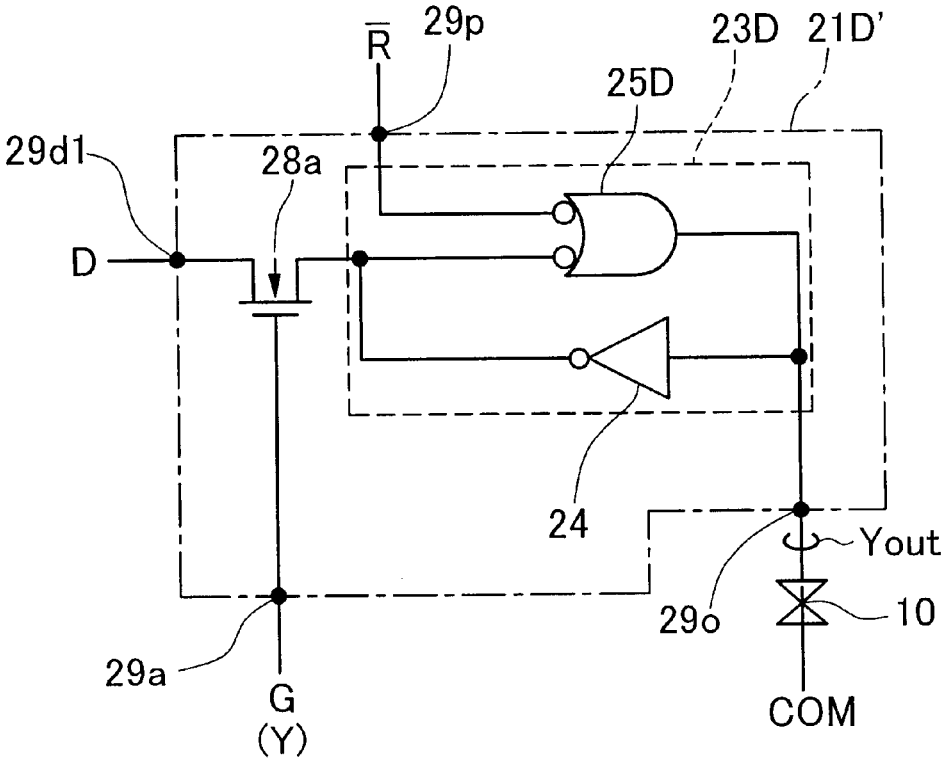
FIG. 21 is a block diagram illustrating a fourth modified example of the memory cell 21' (FIG. 17)

FIG. 17 is a block diagram illustrating the internal structure of each of the memory cells 21' shown in FIG. 16 as an example. This memory cell 21' has a similar configuration to that of FIG. 8, except that the memory cell 21' has only one switching element 28*a* and that the data signal D is supplied to the data terminal 29*d*1 connecting with the switching element 28*a*.

Like the memory cell 21 of the fist embodiment, the memory cell 21' of this arrangement enables the output of the storage section 23 to be readily set in a predetermined state, regardless of the data previously stored in the storage section 23.

B-1. Modifications:

FIGS. 18, 19, 20, and 21 are block diagrams respectively illustrating first through fourth modified examples of the memory cell 21' (FIG. 17). The memory cells 21A', 21B', 21C', and 21D' shown in FIGS. 18 through 21 respectively have substantially similar configurations to those of the memory cells 21A, 21B, 21C, and 21D shown in FIGS. 11 through 14, except that any of the memory cells 21A' through 21D' has only one switching element 28*a* and that the data signal D is supplied to the data terminal 29*d*1 connecting with the switching element 28*a*.

Figure 22:
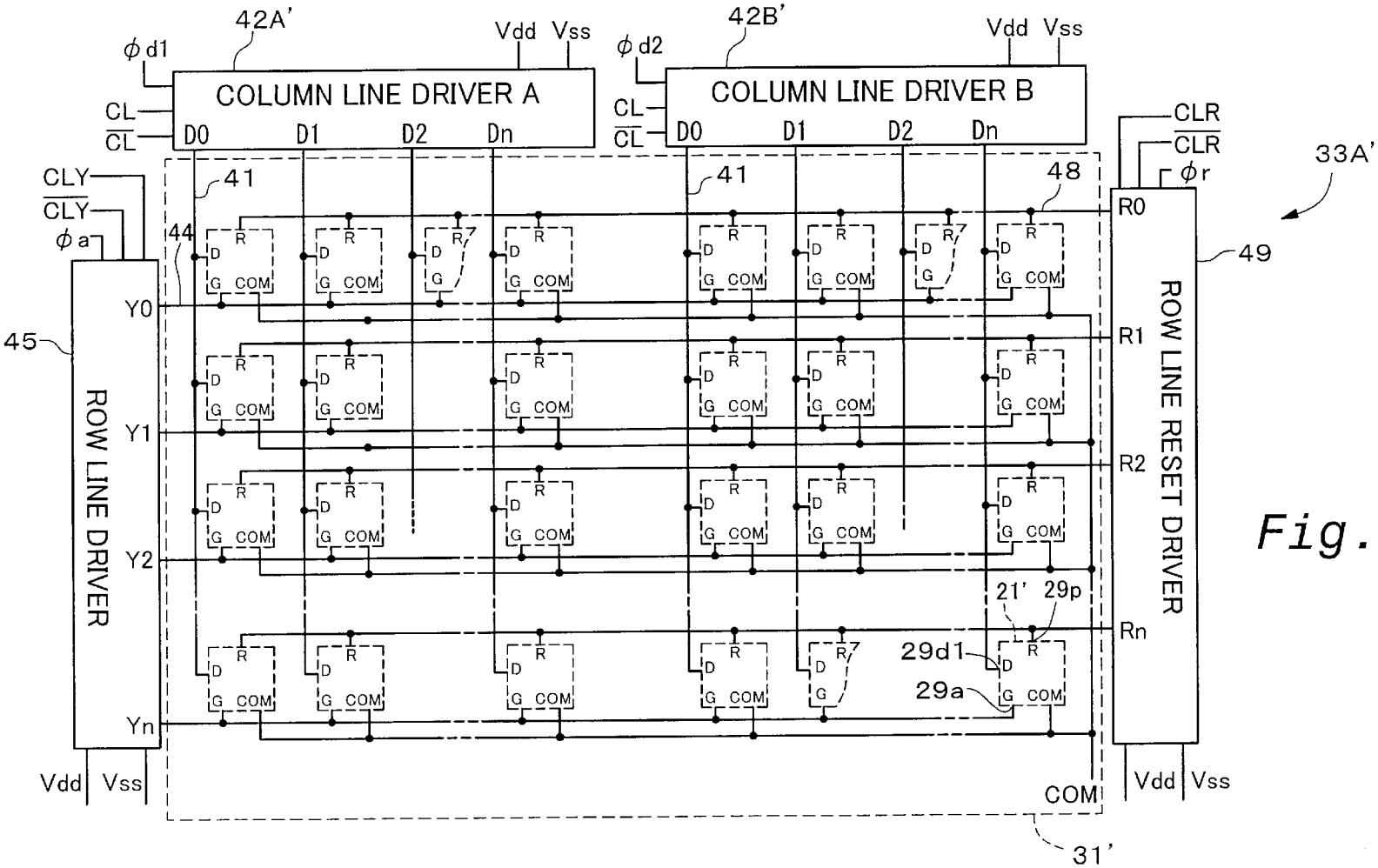
FIG. 22 is a block diagram illustrating a modified example of the digital drive device 33' (FIG. 16).

FIG. 22 is a block diagram illustrating a modified example of the digital drive device 33' (FIG. 16). The digital drive device 33A' shown in FIG. 22 has a similar structure to that of FIG. 16, except that the column line driver comprises two partial column line drivers 42A' and 42B'. Like the digital drive device 33A shown in FIG. 15, this arrangement advantageously reduces the quantity of data that are subjected to serial-to-parallel conversion by each of the partial column line drivers 42A' and 42B', thus enabling the data signal D to be supplied to the respective memory cells 21' at a relatively high speed.

The present invention is not restricted to the above embodiments or their modifications, but there may be many other modifications, changes, and alterations without departing from the scope or spirit of the main characteristics of the present invention. Some examples of possible modification are given below.

(1) In the above embodiments, the rotary color filter 52 sequentially extracts and emits three color light components, red, green, and blue. The rotary color filter may alternatively be designed to sequentially extract and emit different color light components including intermediate tints. The combination of the light source device 51 and the rotary color filter 52 may be replaced with three light source devices (for example, LEDs) that individually emit three monochromatic color lights, red, green and blue.

(2) In the above embodiments, the potential of the upper electrode 7 in each light modulation element 10 is set to the common ground potential, while the potential of the lower electrode 8 is varied. The reverse settings may be applied for the potentials of the upper electrode 7 and the lower electrode 8. In the light modulation elements 10 arranged in a two-dimensional matrix, however, it is preferable to ground the upper electrodes 7 of all the light modulation elements 10, which accordingly have the common ground potential.

(3) In the above embodiments, the actuator section 6 has two electrodes (the upper electrode and the lower electrode). The actuator section may additionally have an intermediate electrode that works between the two electrodes. In this modified structure, potentials of different polarities are set to the two electrodes, and the output of the memory cell is given to the intermediate electrode, which links with the reflecting prism 4. This arrangement advantageously allows movement of the intermediate electrode when the output voltage of the memory cell is relatively low.

The actuator section 6 that uses the two electrodes for electrostatic actuation may be replaced with an actuator section using piezoelectric elements.

(4) In the above embodiments, the light modulation device 35 uses the evanescent light switching device (ESD) for the light modulation elements 10. Any of other suitable light modulation elements, such as liquid crystal or DMD (digital micromirror device: trade mark by TI Inc.), may be used instead. The light modulation element that modulates (switches on and off) externally given incident light and emits the modulated light may be replaced with a spontaneous emission element like an organic EL (electroluminescence) element.

In general, the image display apparatus is required to have a light emission apparatus that includes a plurality of light emission elements, which emit light in response to the output of a plurality of memory cells included in a digital drive apparatus.

(5) In the above embodiments, the image of one picture screen is displayed in one frame period as shown in FIG. 9. The principle of the present invention is, however, also applicable to a modified structure that displays the image of one picture screen in a plurality of sub-frame periods. The advantage of this modified structure is to relatively lengthen the display time of the image of one picture screen.

(6) In the above embodiments, the SRAM circuit with the reset function is used for the storage section. A sample-and-hold circuit with the reset function may be applied instead.

(7) The image display apparatus 50 of the above embodiments is the projector that displays projected images on the screen SC. The image display apparatus may be a direct viewing display apparatus.

(8) The above embodiments regard the image display apparatus 50 that adopts the color sequential technique. The principle of the present invention is also applicable to image display apparatuses that adopt different techniques.

What is claimed is:

1. A digital drive apparatus for driving a light emission apparatus including a plurality of light emission elements, comprising a memory cell array including a plurality of memory cells that are arranged in a matrix and are corresponding to the plurality of light emission elements, each of the memory cells comprising:

a storage section that stores a supply of data therein and that is capable of keeping output corresponding to the stored data, the stored data representing state of the corresponding light emission element;

a transfer element that is capable of transferring the data to the storage section;

an address terminal that supplies an address signal to the transfer element, the address signal controlling operation of the transfer element;

a data terminal that is connected with the transfer element and supplies the data to the storage section via the transfer element;

an output terminal that outputs the data stored in the storage section; and a reset terminal that supplies a reset signal to the storage section, the reset signal resetting the storage section by deleting the data stored in the storage section to set the output of the storage section to a predetermined state regardless of the data previously stored in the storage section.

2. A digital drive apparatus in accordance with claim 1, wherein the storage section comprises:

an inverter; and either one of a 2-input NAND gate and a 2-input NOR gate, an output terminal of either one of the 2-input NAND gate and the 2-input NOR gate being connected with an input terminal of the inverter, one input terminal of either one of the 2-input NAND gate and the 2-input NOR gate being connected with an output terminal of the inverter and the other input terminal being connected with the reset terminal.

3. A digital drive apparatus in accordance with claim 2, wherein the memory cell further comprises:

a buffer circuit that converts an output voltage of the storage section.

4. A digital drive apparatus in accordance with claim 2, wherein the memory cell array further comprises:

a plurality of first signal lines, each of the first signal lines connecting in parallel one set of address terminals, which are included in one set of memory cells aligned in a direction of rows;

a plurality of second signal lines, each of the second signal lines connecting in parallel one set of data terminals, which are included in one set of memory cells aligned in a direction of columns; and a plurality of third signal lines, each of the third signal lines connecting in parallel one set of reset terminals, which are included in the one set of memory cells aligned in the direction of rows, wherein said digital drive apparatus further comprises:

a first driver circuit that sequentially supplies the address signal to each set of memory cells aligned in the direction of rows via the plurality of first signal lines;

a second driver circuit that simultaneously supplies the data signal to each set of memory cells arranged in the direction of columns via the plurality of second signal lines; and a third driver circuit that sequentially supplies the reset signal to each set of memory cells aligned in the direction of rows via the plurality of third signal lines.

5. A digital drive apparatus in accordance with claim 4, wherein the third driver circuit is capable of supplying the reset signal to a specific set of memory cells at a specific timing after the first driver circuit has supplied the address signal to the specific set of memory cells.

6. A digital drive apparatus in accordance with claim 5, wherein the specific timing is variable.

7. A digital drive apparatus in accordance with claim 5, further comprising:

a control circuit that causes the first driver circuit and the third driver circuit to output the address signal and the reset signal in one frame period.

8. An image display apparatus, comprising:

the digital drive apparatus in accordance with claim 1; and the light emission apparatus that includes the plurality of light emission elements, which emit light in response to output of the plurality of memory cells included in the digital drive apparatus.

9. An image display apparatus in accordance with claim 8, further comprising:

a lens that projects the light emitted from the light emission apparatus.

10. An image display apparatus in accordance with claim 8, wherein each of the plurality of light emission elements modulates externally given incident light and emits modulated light.

11. A digital storage unit for constituting a digital storage unit array including a plurality of the digital storage units, the digital storage unit being corresponding to a light modulation element for constituting a light modulation element array including a plurality of the light modulation elements, the digital storage unit, comprising:

a storage section that stores therein data representing state of the light modulation element;

an active element that is capable of transferring the data to the storage section;

a data terminal that supplies the data to the storage section via the active element;

an address terminal that supplies an address signal to the active element, the address signal controlling the active element;

an output terminal that outputs the data stored in the storage section; and a reset terminal that supplies a reset signal to the storage section, the reset signal resetting the storage section by deleting the data stored in the storage section to set the output of the storage section to a predetermined state regardless of the data previously stored in the storage section, and the output resetting the state of the light modulation element in response to the reset signal.

12. A digital storage unit in accordance with claim 11, wherein the storage section is an SRAM circuit having a reset function.

13. A digital storage unit in accordance with claim 12, wherein the SRAM circuit comprises:

either one of a 2-input NAND gate and a 2-input NOR gate, where the reset signal is given to one of input terminals; and an inverter, wherein either one of the 2-input NAND gate and the 2-input NOR gate and the inverter are connected to each other to form a loop.

14. A digital storage unit in accordance with claim 11, further comprising:

a buffer circuit that converts an output voltage of the storage section and transmits the converted output voltage to the light modulation element.

15. A digital storage apparatus, comprising:

the plurality of digital storage units in accordance with claim 11 that are arranged in a two-dimensional manner;

a plurality of first signal lines, each of the first signal lines connecting in parallel one set of address terminals, which are included in one set of digital storage units aligned in a first direction, each first signal line receiving the address signal;

a plurality of second signal lines, each of the second signal lines connecting in parallel one set of data terminals, which are included in one set of digital storage units aligned in a second direction that is perpendicular to the first direction, each second signal line receiving the data signal; and a plurality of third signal lines, each of the third signals lines connecting in parallel one set of reset terminals, which are included in the one set of digital storage units aligned in the first direction, each third signal line receiving the reset signal.

16. A digital drive apparatus, comprising:

the digital storage apparatus in accordance with claim 15;

a first driver circuit that causes the address signal to be supplied to the plurality of first signal lines;

a second driver circuit that causes the data signal to be supplied to the plurality of second signal lines; and a third driver circuit that causes the reset signal to be supplied to the plurality of third signal lines.

17. A digital drive apparatus in accordance with claim 16, wherein the third driver circuit is capable of supplying the reset signal to a specific set of digital storage units at a specific timing after the first driver circuit has supplied the address signal to the specific set of digital storage units.

18. A digital drive apparatus in accordance with claim 16, wherein the first driver circuit comprises a shift register circuit and an AND logic circuit.

19. A digital drive apparatus in accordance with claim 16, wherein the third driver circuit comprises a shift register circuit and an AND logic circuit.

20. A digital drive apparatus in accordance with claim 16, wherein the second driver circuit comprises a shift register circuit and an analog switch circuit, and an enable signal that regulates output timing of the data signal is supplied to the analog switch circuit.

21. A digital drive apparatus in accordance with claim 16, wherein the second driver circuit comprises a plurality of partial driver circuits, and each of the partial driver circuits supplies the data signal to at least part of the plurality of digital storage units.

22. A digital drive apparatus in accordance with claim 17, further comprising:

a control circuit that causes the first driver circuit and the third driver circuit to output the address signal and the reset signal in an identical frame period.

23. An image display apparatus, comprising:

the digital drive apparatus in accordance with claim 16; and the light modulation elements, each being driven by each of the plurality of digital storage units included in the digital drive apparatus.

24. An image display apparatus in accordance with claim 23, further comprising:

a lens that projects the light output from the light modulation elements.

25. A method of controlling a digital drive apparatus in accordance with claim 16, comprising the step of:

causing the third driver circuit to supply the reset signal to a specific set of digital storage units at a specific timing after the first driver circuit has supplied the address signal to the specific set of digital storage units.

26. A method in accordance with claim 25, wherein the address signal and the reset signal are supplied in an identical frame period.

* * * * *